US010880636B2

(12) United States Patent
Brown et al.

(10) Patent No.: US 10,880,636 B2
(45) Date of Patent: Dec. 29, 2020

(54) AUDIO SPEAKER WITH FULL-RANGE UPWARD FIRING DRIVER FOR REFLECTED SOUND PROJECTION

(71) Applicant: Dolby Laboratories Licensing Corporation, San Francisco, CA (US)

(72) Inventors: C. Phillip Brown, Castro Valley, CA (US); Michael J. Smithers, Kareela (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/469,583

(22) PCT Filed: Dec. 15, 2017

(86) PCT No.: PCT/US2017/066663
§ 371 (c)(1),
(2) Date: Jun. 13, 2019

(87) PCT Pub. No.: WO2018/112335
PCT Pub. Date: Jun. 21, 2018

(65) Prior Publication Data

US 2020/0084538 A1 Mar. 12, 2020

Related U.S. Application Data

(60) Provisional application No. 62/435,611, filed on Dec. 16, 2016.

(30) Foreign Application Priority Data

Jan. 23, 2017 (EP) ..... 17152621

(51) Int. Cl.
*H04R 1/34* (2006.01)
*H04R 1/02* (2006.01)
(Continued)

(52) U.S. Cl.
CPC ..... *H04R 1/345* (2013.01); *H04R 1/025* (2013.01); *H04R 1/24* (2013.01); *H04R 3/04* (2013.01)

(58) Field of Classification Search
CPC .. H04R 1/26; H04R 3/12; H04R 1/345; H04S 2400/11; H04S 2400/01; H04S 7/302
See application file for complete search history.

(56) References Cited

U.S. PATENT DOCUMENTS 4,073,365 A 2/1978 Johnson
4,441,577 A 4/1984 Kurihara
(Continued)

FOREIGN PATENT DOCUMENTS

EP 624047 11/1994
JP S60-259093 12/1985
(Continued)

OTHER PUBLICATIONS

Rane Corporation, AC 22 and AC 23 Active Crossovers Operating and Service Manual, Oct. 1988, <URL: https://www.ranecommercial.com/legacy/oldman.html> (Year: 1988).*

*Primary Examiner* — Kile O Blair

(57) ABSTRACT

Embodiments are directed to an upward-firing speaker that reflects sound off a ceiling to a listening location at a distance from a speaker. The reflected sound provides height cues to reproduce audio objects that have overhead audio components. The speaker comprises a direct-firing tweeter and an upward-firing full-range driver in a unitary enclosure for playback of front-channel and height-channel signals, respectively. A crossover passes high frequencies of a front-channel signal directly to the tweeter and combines low frequencies of the front-channel signal with the height channel signal to be played through the full-range driver. A virtual height filter is applied to the height channel signal to improve the perception of height for audio signals transmit-
(Continued)

ted by the virtual height speaker to provide optimum reproduction of the overhead reflected sound.

18 Claims, 18 Drawing Sheets

(51) Int. Cl.
*H04R 1/24* (2006.01)
*H04R 3/04* (2006.01)

(56) References Cited

U.S. PATENT DOCUMENTS

| | | | | |
|---|---|---|---|---|
| 4,797,933 | A | 1/1989 | Hahne | |
| 7,940,923 | B2 | 5/2011 | Rodman | |
| 8,363,865 | B1 | 1/2013 | Bottum | |
| 8,638,959 | B1 | 1/2014 | Hall | |
| 8,873,787 | B2 * | 10/2014 | Bergere | H04R 1/24 181/199 |
| 9,648,440 | B2 * | 5/2017 | Crockett | H04R 1/26 |
| 9,693,162 | B2 * | 6/2017 | Yu | H04R 29/001 |
| 10,440,492 | B2 * | 10/2019 | Crockett | H04R 5/02 |
| 2014/0126753 | A1 | 5/2014 | Takumai | |

FOREIGN PATENT DOCUMENTS

| | | | | |
|---|---|---|---|---|
| WO | 2007127781 | | 11/2007 | |
| WO | 2014107714 | | 7/2014 | |
| WO | WO-2015105788 | A1 * | 7/2015 | H04S 7/301 |

* cited by examiner $$H[z] = \frac{0.9911 - 1.3044z^{-1} + 1.3382z^{-2} - 0.8314z^{-3} + 0.3840z^{-4}}{1.000 - 1.3143z^{-1} + 1.2533z^{-2} - 0.6224z^{-3} + 0.2656z^{-4}}$$

AUDIO SPEAKER WITH FULL-RANGE UPWARD FIRING DRIVER FOR REFLECTED SOUND PROJECTION

FIELD OF THE INVENTION

One or more implementations relate generally to audio speakers, and more upward firing speakers and associated height filter circuits for rendering adaptive audio content using reflected signals.

BACKGROUND

The advent of digital cinema has created new standards for cinema sound, such as the incorporation of multiple channels of audio to allow for greater creativity for content creators and a more enveloping and realistic auditory experience for audiences. Model-based audio descriptions have been developed to extend beyond traditional speaker feeds and channel-based audio as a means for distributing spatial audio content and rendering in different playback configurations. The playback of sound in true three-dimensional (3D) or virtual 3D environments has become an area of increased research and development. The spatial presentation of sound utilizes audio objects, which are audio signals with associated parametric source descriptions of apparent source position (e.g., 3D coordinates), apparent source width, and other parameters. Object-based audio may be used for many multimedia applications, such as digital movies, video games, simulators, and is of particular importance in a home environment where the number of speakers and their placement is generally limited or constrained by the confines of a relatively small listening environment.

Various technologies have been developed to more accurately capture and reproduce the creator's artistic intent for a sound track in both full cinema environments and smaller scale home environments. A next generation spatial audio (also referred to as "adaptive audio") format, and embodied in the Dolby® Atmos® system, has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible manner. The parametric source description associated with each object, such as a positional trajectory in 3D space, is taken as an input along with the number and position of speakers connected to the decoder. The renderer utilizes certain algorithms to distribute the audio associated with each object across the attached set of speakers. The authored spatial intent of each object is thus optimally presented over the specific speaker configuration that is present in the listening environment.

Current spatial audio systems provide unprecedented levels of audience immersion and the highest precision of audio location and motion. However, since they have generally been developed for cinema use, they involve deployment in large rooms and the use of relatively expensive equipment, including arrays of multiple speakers distributed around a theater. An increasing amount of advanced audio content, however, is being made available for playback in the home environment through streaming technology and advanced media technology, such as Blu-ray (or similar) disks, and so on. For optimal playback of spatial audio (e.g., Dolby Atmos) content, the home listening environment should include speakers that can replicate audio meant to originate above the listener in three-dimensional space. To achieve this, consumers can mount additional speakers on the ceiling in recommended positions above the traditional two-dimensional surround system, and some home theater enthusiasts are likely to embrace this approach. For many consumers, however, such height speakers may not be affordable or may pose installation difficulties. In this case, the height information is lost if overhead sound objects are played only through floor or wall-mounted speakers.

What is needed, therefore, is a speaker design that enables small, low-cost speakers to replicate audio as if the sound source originated from the ceiling to allow effective playback of audio for audio objects that represent height sources.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby and Atmos are registered trademarks of Dolby Laboratories Licensing Corporation.

BRIEF SUMMARY OF EMBODIMENTS

Embodiments are directed to a speaker for a speaker for transmitting sound waves to be reflected off an upper surface of a listening environment, comprising a cabinet, a direct-firing tweeter driver mounted to a front-facing surface of the cabinet and oriented to transmit sound along a horizontal axis substantially perpendicular to a front surface of the cabinet, and an upward-firing full-range driver mounted to a sloping surface of the cabinet and oriented at an inclination angle of between 18 degrees to 22 degrees relative to the horizontal axis (the inclination angle may for example be defined or measured as the angle between the horizontal axis and a mounting plane of the upward-firing full-range driver). The upward-firing driver is mounted flush to an upward sloping side of the cabinet or inset within a top surface of the cabinet and configured to reflect sound off a reflection point on a ceiling of the listening environment, and wherein a corresponding angle for direct response from the upward-firing driver is nominally 70 degrees from the horizontal axis. The speaker further has a first input receiving a front channel signal comprising direct sound components to be sent to the direct-firing tweeter, and a second input receiving a height channel signal receiving height sound components to be sent to the upward-firing full-range driver for reflection down to the listening area. The speaker also has a crossover coupled to the direct-firing tweeter, the crossover comprising a high-pass filter passing high frequency signals of the direct sound components directly to the tweeter, and a low-pass filter passing low frequency of the direct sound components to the upward-firing full-range driver.

In an embodiment, the speaker has a virtual height filter circuit coupled to the upward-firing full-range driver and applying a frequency response curve to a signal transmitted to the upward-firing driver to create a target transfer curve. The virtual height filter compensates for height cues present in sound waves transmitted directly through the listening environment in favor of height cues present in the sound reflected off the upper surface of the listening environment. The speaker may also have a delay circuit configured to time align the direct-firing tweeter and the upward-firing full-range driver by compensating for a spatial distance between the two relative to the listening area, and an attenuation circuit configured to attenuate the direct sound components to compensate for a difference in driver efficiency between the full-range and the tweeter. In combination with the delay circuit, the crossover filters may be chosen to provide substantial phase matching of the responses of both the full-range driver and the tweeter in the direction of the tweeter toward the listening area. The cabinet may be a unitary single speaker cabinet or it may be configured to hold two or more sets of upward-firing woofers or full-range drivers and direct-firing tweeters in a soundbar configuration.

Embodiments are further directed to a speaker system for reflecting sound waves off a room ceiling to a listening position in the room having a cabinet, a direct-firing tweeter within the cabinet and oriented to transmit sound along a horizontal axis substantially perpendicular to a front surface of the cabinet, an upward-firing full-range driver mounted to an inclined top surface of the cabinet and configured to reflect sound off a reflection point on the ceiling, and wherein a corresponding angle for direct response from the upward-firing driver is nominally 70 degrees from the horizontal axis, and a virtual height filter circuit applying a frequency response curve to a signal transmitted to the upward-firing driver to create a target transfer curve that compensates for height cues present in sound waves transmitted directly through the room in favor of height cues present in the sound reflected off the ceiling by at least partially removing directional cues from the speaker location and at least partially inserting directional cues from the reflection point. The speaker system further has a first input receiving a front channel signal comprising direct sound components to be sent to the direct-firing tweeter, and a second input receiving a height channel signal receiving height sound components to be sent to the upward-firing woofer for reflection down to the listening area. It also has a crossover coupled to the direct-firing tweeter, the crossover comprising a high-pass filter passing high frequency signals of the direct sound components directly to the tweeter, and a low-pass filter passing low frequency of the direct sound components to the upward-firing full-range driver. The full-range driver may be a three-inch cone driver and the tweeter may be a one-inch dome tweeter.

Embodiments are yet further directed to a method for generating an audio scene from a speaker by receiving first and second audio signals, routing the first audio signal to a direct-firing tweeter of the speaker, routing the second audio signal to an upward-firing full-range driver of the speaker, orienting the upward-firing full-range driver at a defined tilt angle relative to a horizontal angle defined by the front-firing driver in order to transmit sound upward to a reflection point on a ceiling of the room so that it reflects down to a listening area at a distance from the speaker in the room, and applying a virtual height filter frequency response curve to the second audio signal to compensate for height cues present in sound waves transmitted directly through the room in favor of height cues present in the sound reflected off the ceiling of the room. The method may also apply a high-pass filter passing high frequency signals of the first audio signal directly to the tweeter, and a low-pass filter passing low frequency of the second audio signal to the upward-firing full-range driver.

In an embodiment, the cabinet may be configured such that the full range driver projects sound against one of a side surface or wall to reflect sound back into the listening area, or a floor to reflect sound back up into the listening area. Likewise, the enclosure or a soundbar incorporating the upward-firing speaker may include one or more side or bottom firing drivers to reflect sound off of other surfaces of the listening environment, such as the wall, floor, screens, partitions, and so on.

Embodiments are yet further directed to methods of making and using or deploying the speakers, circuits, and transducer designs that optimize the rendering and playback of reflected sound content.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1:
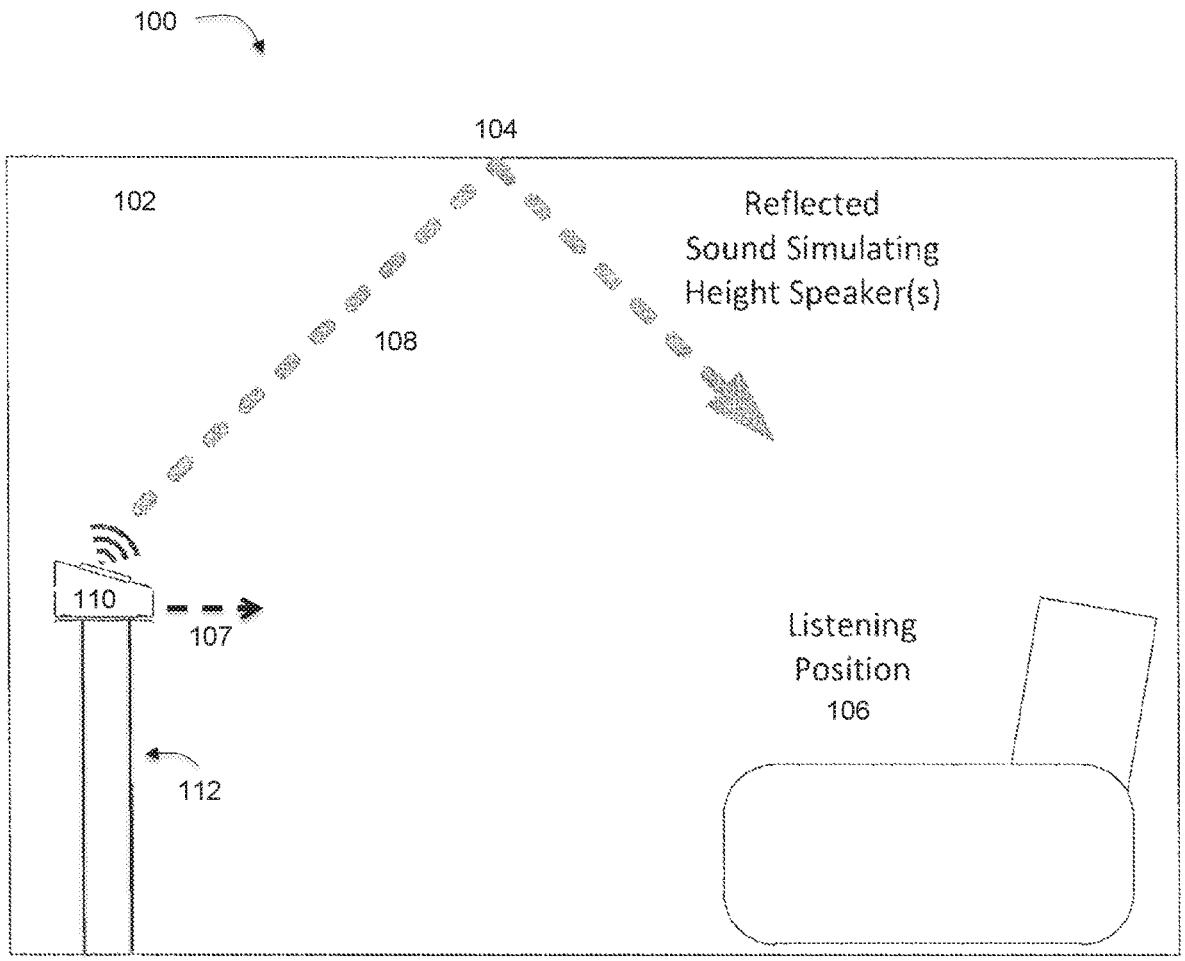
FIG. 1 illustrates the use of an upward-firing driver using reflected sound to simulate an overhead speaker in a listening environment.

Embodiments are described for audio speakers and transducer systems that include upward firing drivers to render adaptive audio content intended to provide an immersive audio experience. The speakers may include or be used in conjunction with an adaptive audio system having virtual height filter circuits for rendering object based audio content using reflected sound to reproduce overhead sound objects and provide virtual height cues. Aspects of the one or more embodiments described herein may be implemented in an audio or audio-visual (AV) system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; and "adaptive audio" means channel-based and/or object-based audio signals plus metadata that renders the audio signals based on the playback environment using an audio stream plus metadata in which the position is coded as a 3D position in space; and "listening environment" means any open, partially enclosed, or fully enclosed area, such as a room that can be used for playback of audio content alone or with video or other content, and can be embodied in a home, cinema, theater, auditorium, studio, game console, and the like. Such an area may have one or more surfaces disposed therein, such as walls or baffles that can directly or diffusely reflect sound waves.

Embodiments are directed to a reflected sound rendering system that is configured to work with a sound format and processing system that may be referred to as a "spatial audio system" or "adaptive audio system" that is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements. Such a combined approach provides greater coding efficiency and rendering flexibility compared to either channel-based or object-based approaches taken separately. An example of an adaptive audio system that may be used in conjunction with present embodiments is embodied in the commercially-available Dolby Atmos system.

In general, audio objects can be considered as groups of sound elements that may be perceived to emanate from a particular physical location or locations in the listening environment. Such objects can be static (stationary) or dynamic (moving). Audio objects are controlled by metadata that defines the position of the sound at a given point in time, along with other functions. When objects are played back, they are rendered according to the positional metadata using the speakers that are present, rather than necessarily being output to a predefined physical channel. In an embodiment, the audio objects that have spatial aspects including height cues may be referred to as "diffused audio." Such diffused audio may include generalized height audio such as ambient overhead sound (e.g., wind, rustling leaves, etc.) or it may have specific or trajectory-based overhead sounds (e.g., birds, lightning, etc.).

Dolby Atmos is an example of a system that incorporates a height (up/down) dimension that may be implemented as a 9.1 surround system, or similar surround sound configuration (e.g., 11.1, 13.1, 19.4, etc.). A 9.1 surround system may comprise composed five speakers in the floor plane and four speakers in the height plane, and may be referred to as a 5.1.4 system (5 floor, 1 LFE, 5 height speakers). In general, these speakers may be used to produce sound that is designed to emanate from any position more or less accurately within the listening environment. In a typical commercial or professional implementation speakers in the height plane are usually provided as ceiling mounted speakers or speakers mounted high on a wall above the audience, such as often seen in a cinema. These speakers provide height cues for signals that are intended to be heard above the listener by directly transmitting sound waves down to the audience from overhead locations.

Upward Firing Speaker System

In many cases, such as typical home environments, ceiling mounted overhead speakers are not available or practical to install. In this case, the height dimension must be provided by floor or low wall mounted speakers. In an embodiment, the height dimension is provided by a speaker system having upward-firing drivers that simulate height speakers by reflecting sound off of the ceiling. In an adaptive audio system, certain virtualization techniques are implemented by the renderer to reproduce overhead audio content through these upward-firing drivers, and the drivers use the specific information regarding which audio objects should be rendered above the standard horizontal plane to direct the audio signals accordingly.

For purposes of description, the term "driver" means a single electroacoustic transducer (or tight array of transducers) that produces sound in response to an electrical audio input signal. A driver may be implemented in any appropriate type, geometry and size, and may include horns, cones, ribbon transducers, and the like. The term "speaker" means one or more drivers in a unitary enclosure, and the terms "cabinet" or "housing" mean the unitary enclosure that encloses one or more drivers. Thus, an upward-firing speaker or speaker system comprises a speaker cabinet that includes at least upward-firing driver and one or more other direct-firing drivers (e.g., tweeter plus main or woofer), and other associated circuitry (e.g., crossovers, filters, etc.). The direct-firing driver (or front-firing driver) refers to the driver that transmits sound along the main axis of the speaker, typically horizontally out the front face of the speaker.

FIG. 1 illustrates the use of an upward-firing driver using reflected sound to simulate one or more overhead speakers. Diagram 100 illustrates an example in which a listening position 106 is located at a particular place within a listening environment. The system does not include any height speakers (e.g., ceiling mounted) for directly transmitting audio content containing height cues. Instead, the speaker cabinet or speaker array includes an upward-firing driver along with a front firing driver. The upward-firing driver is configured (with respect to location and inclination angle) to send its sound wave 108 up to a particular point 104 on the ceiling 102 where it reflected back down to the listening position 106. It is assumed that the ceiling is made of an appropriate material and composition to adequately reflect sound down into the listening environment. The relevant characteristics of the upward-firing driver (e.g., size, power, location, etc.) may be selected based on the ceiling composition, room size, and other relevant characteristics of the listening environment.

The speaker may be placed on a stand or column 112 of any appropriate height to raise the speaker drivers to the appropriate height for the size of the listening environment and the location/height of the listening position. Alternatively, the cabinet may be configured to allow the driver to be floor standing, or placed on appropriate furniture, such as a cabinet, bookshelf, desk, and so on.

FIG. 1 illustrates an embodiment in which the upward-firing and direct-firing drivers are provided in the same cabinet. Such a speaker configuration is integrated in a single cabinet upward/direct firing speaker system. In an alternative embodiment, the upward and direct firing drivers may be housed in their own respective cabinets or portions of a cabinet, but for an embodiment in which the drivers are relatively small (e.g., 5" or less in diameter) and the direct-firing driver is a tweeter, a single integrated cabinet is typically preferred, for cost reduction and packaging/setup convenience, and for the fact that a tweeter generally does not need its own housing, since a tweeter is usually sealed at the back.

Figure 2A:
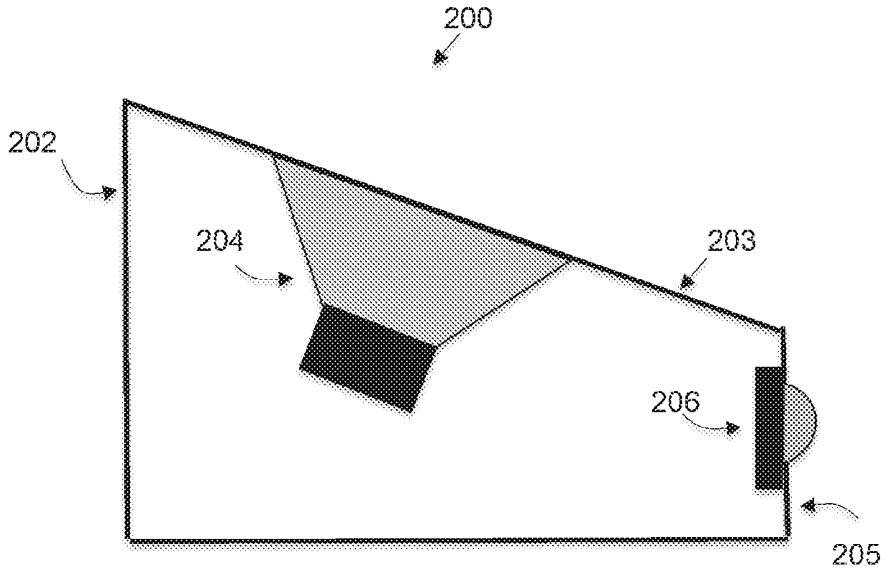
FIG. 2A illustrates an upward firing driver of FIG. 1 in greater detail, according to some embodiments.

FIG. 2A illustrates an upward firing driver of FIG. 1 in greater detail, according to some embodiments. As shown in FIG. 2A, enclosure 202 is shaped to have a front (or direct) side surface 205 that is oriented so that a driver installed against this surface projects sound directly to the listening position substantially along a horizontal plane relative to the floor or ceiling of the listening environment, as shown by sound projection line 107 in FIG. 1. It also has a slanted upward surface 203 that is oriented so that a driver installed against this surface projects sound upward toward the ceiling of the listening environment so that sound is reflected down to the listening position 106, as shown by the sound projection line 108 in FIG. 1.

Figure 2B:
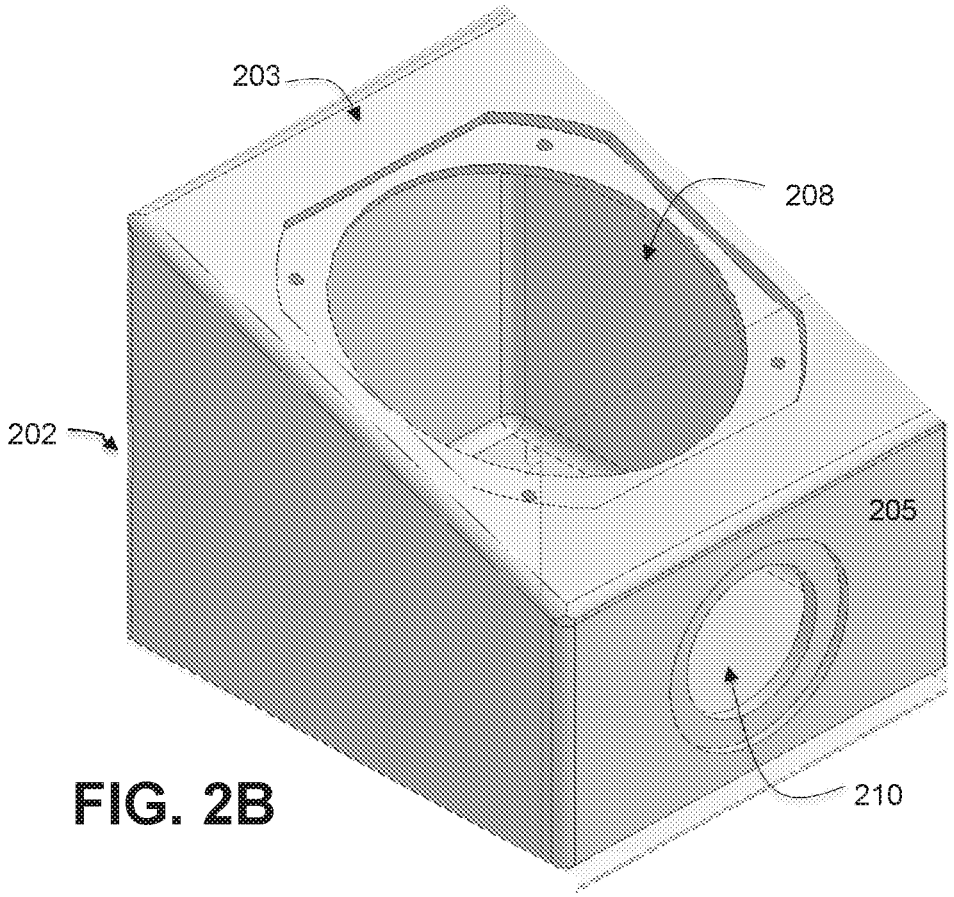
FIG. 2B is a perspective view of the enclosure 202 of FIG. 2A under an embodiment.
Figure 2C:
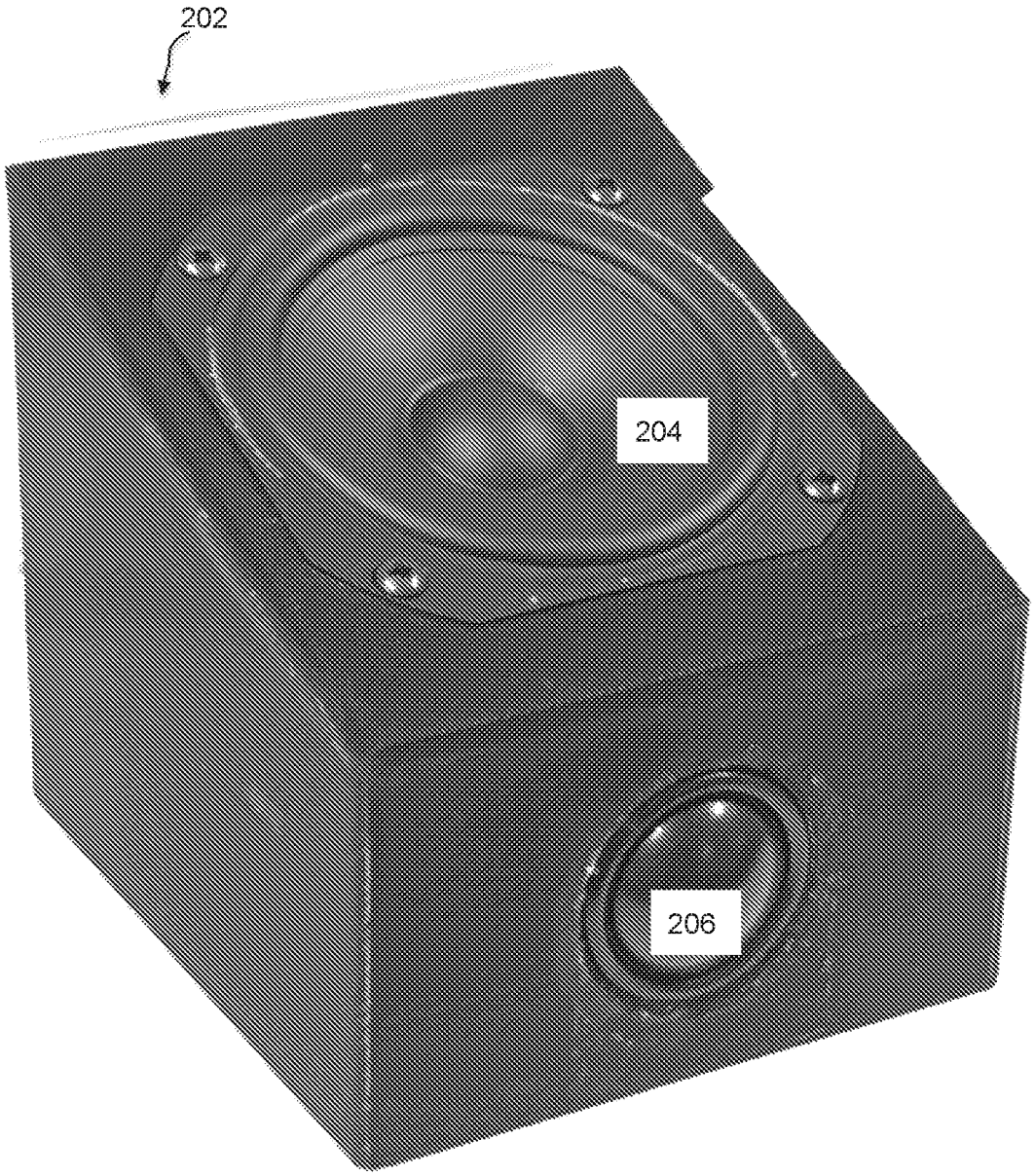
FIG. 2C is a perspective view of the complete speaker 202 of FIG. 2A under an embodiment.

For the embodiment of FIG. 2A, a full-range driver 204 is mounted against the upward slanted surface 203 and a tweeter driver 206 is mounted against the front surface 206. FIG. 2B is a perspective view of the enclosure 202 of FIG. 2A under an embodiment, showing installation hole 208 for the full-range driver and installation hole 210 for the tweeter drilled into their respective cabinet surfaces 203 and 205. FIG. 2C is a perspective view of the complete speaker 202 of FIG. 2A showing full-range driver 204 and tweeter 206 installed in the enclosure and against the upward slanted and front surfaces, respectively.

Although only one upward-firing driver is shown in FIG. 2A, multiple upward-firing and/or direct-firing drivers may be incorporated into the speaker in some embodiments. For the embodiment of FIG. 2, it should be noted that the drivers may be of any appropriate, shape, size and type depending on the frequency response characteristics required, as well as any other relevant constraints, such as size, power rating, component cost, and so on; although for this embodiment, the upward firing driver is a full-range driver that is capable of playing back a full practical range of audio frequencies (e.g., 20-20 kHz), and may be embodied generally as a woofer transducer (low/mid/mid-high frequency) and the direct firing driver is a tweeter transducer (high frequency). The term "woofer" may be used interchangeably herein with "full-range" driver, and means any suitable piston driver that is capable playing back a full spectrum of low, mid and high range frequencies.

As shown in FIGS. 1 and 2A-2C, the upward-firing driver is positioned such that it projects sound at an angle up to the ceiling where it can then bounce back down to a listener. The angle of tilt may be set depending on listening environment characteristics and system requirements. For example, the upward-firing driver 204 may be tilted up between 20 and 60 degrees and may be positioned above the direct-firing driver 206 in the speaker enclosure 202 so as to minimize interference with the sound waves produced from the direct-firing driver 206. The upward-firing driver 204 may be installed at a fixed angle, or it may be installed such that the tilt angle may be adjusted manually. Alternatively, a servo mechanism may be used to allow automatic or electrical control of the tilt angle and projection direction of the upward-firing driver. For certain sounds, such as ambient sound, the upward-firing driver may be pointed straight up out of an upper surface of the speaker enclosure 202 to create what might be referred to as a "top-firing" driver. In this case, a large component of the sound may reflect back down onto the speaker, depending on the acoustic characteristics of the ceiling. In most cases, however, some tilt angle is usually used to help project the sound through reflection off the ceiling to a different or more central location within the listening environment.

Figure 3:
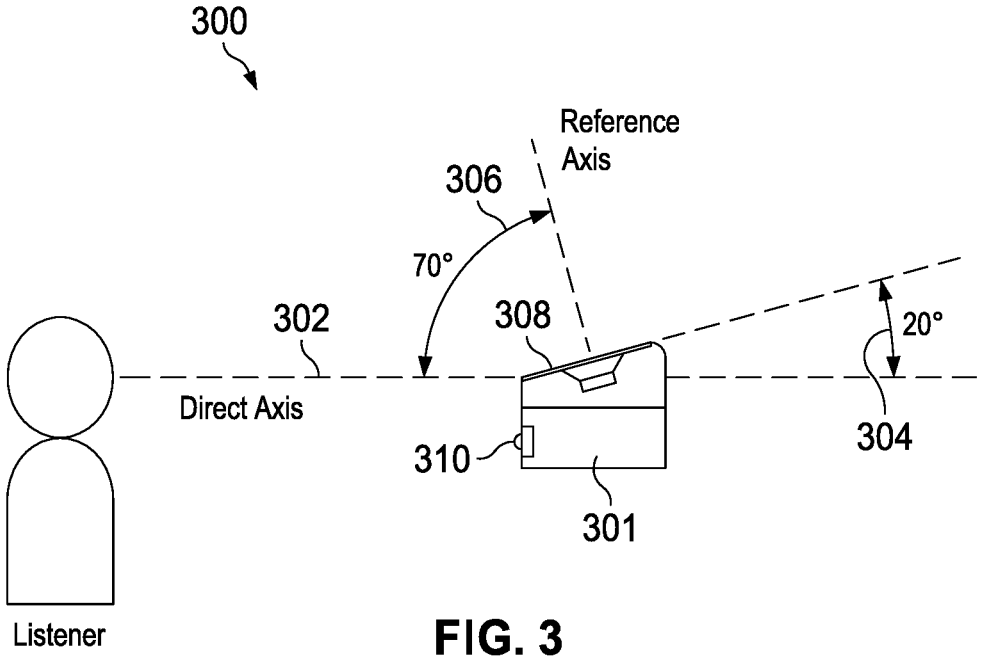
FIG. 3 illustrates the relative tilt angle of the upward-firing driver to the direct-firing driver, under an embodiment.

In an embodiment, the top-firing speaker mounting plane is be tilted forward at an angle between 18° and 22° (20° nominal) relative to the horizontal plane. This is shown in FIG. 3, which illustrates the tilt angle of the upward-firing driver relative to the direct-firing driver, for speaker 301. As shown in diagram 300, the direct-firing driver 310 projects sound along a direct axis 302 perpendicular or substantially perpendicular to a front surface of the speaker cabinet to the listener, and substantially horizontal or parallel to the floor, as stated above. The upward-firing driver 308 is angled at tilt angle of 20° off of the direct axis. The corresponding angle 306 for the direct response from the upward-firing driver 308 to the listener will then nominally be 70°. Although a fairly exact angle 304 of 20° is illustrated, it should be noted that any similar angle may be used, such as any angle in the range of 18° to 22°. In some cases, to achieve the needed directivity of the reflected sound down to the listener, drivers may be mounted so that they are not oriented between 18° and 22° (20° nominal) relative to the horizontal plane. If this is so, all measurements shall still be made relative to the reference axis, which is 20° from the vertical axis. The use of other angles may depend on certain characteristics, such as ceiling height and angles, listener position, wall effects, speaker power, and the like. As shown in FIG. 3, the direct-firing driver 310 (which may for example be a tweeter driver) is oriented to transmit sound out of the speaker 301 in a forward direction along the horizontal axis 302, and the upward-firing driver 308 (which may for example be a full-range driver) is oriented to transmit sound out of the speaker 301 in a direction which forms an acute angle 306 (in other words, an angle which is between 0 and 90 degrees, exemplified in FIG. 3 by an acute angle 306 of 70 degrees) relative to the forward direction.

As shown in FIG. 2A, the upward firing driver 204 is a full-range speaker (referred to herein as a woofer), and the direct firing driver 206 is a tweeter. This type of speaker basically integrates both the full-range audio signal projection and the reflected height signal projection in a single driver, thus saving space and component cost to produce a smaller, cheaper speaker. Compared to other reflected speaker designs, this configuration integrates the low frequencies into the upward facing driver (which is omnidirectional at low frequencies), with a separate forward facing tweeter for high frequencies. In other words, the speaker 200 does not comprise a forward facing low frequency driver, nor a forward facing full-range driver. The height channel uses the upward facing driver across all frequencies, and may be used with a virtual height filter to ensure clarity for both the direct and height components. This allows for one less large driver, and a much smaller amplifier for the front compared to speakers that may use a full-range driver as well as a tweeter for the for the front driving portion.

The speaker design of FIG. 2A uses that fact that a cone driver features the characteristic that as the frequency increases, the directivity of the driver with respect to sound dispersion patterns gets narrower. At low frequencies the cone driver's sound projection can approach nearly omnidirectional (360 degrees) dispersion, while at high frequencies, the sound dispersion becomes narrower and lob shaped (i.e., approaching a beam), and larger diameter drivers become more directional at ever lower frequencies. For example, a 3" driver may be omnidirectional until about 1 kHz and then becomes it becomes increasingly narrower, while a 5" driver may be omnidirectional until only about 500-600 Hz. For a reflective speaker, it is generally desirable that the sound dispersion be relatively narrow due to the benefit of reflecting the sound off of a relatively small spot on the ceiling. If the sound is too dispersed at the ceiling, the reflections may be overly scattered. For the embodiment of FIG. 2A, a relatively small full-range driver (woofer) 204, such as on the order of 3" to 5" is used to project the full-range audio signal including the height components. The low frequency sounds emitted from the driver will be dispersed widely around the listening environment. and against the ceiling, while the high frequency sounds will be transmitted more narrowly against the ceiling for more focused reflected sound transmission. The tweeter 206 is a driver that is configured to transmit the high frequency sound components directly into the listening environment. The tweeter may be implemented as a dome tweeter on the order of 1" diameter (or similar). A dome tweeter generally features greater dispersion patterns than a small cone driver.

Although embodiments are described with respect to certain driver sizes and types, such as a 3" cone woofer and a 1" dome tweeter, it should be noted that any other practical combination of different size/type woofers and tweeters may be used depending on the enclosure shape and size, system configuration, room size, audio content, and so on.

Figure 4:
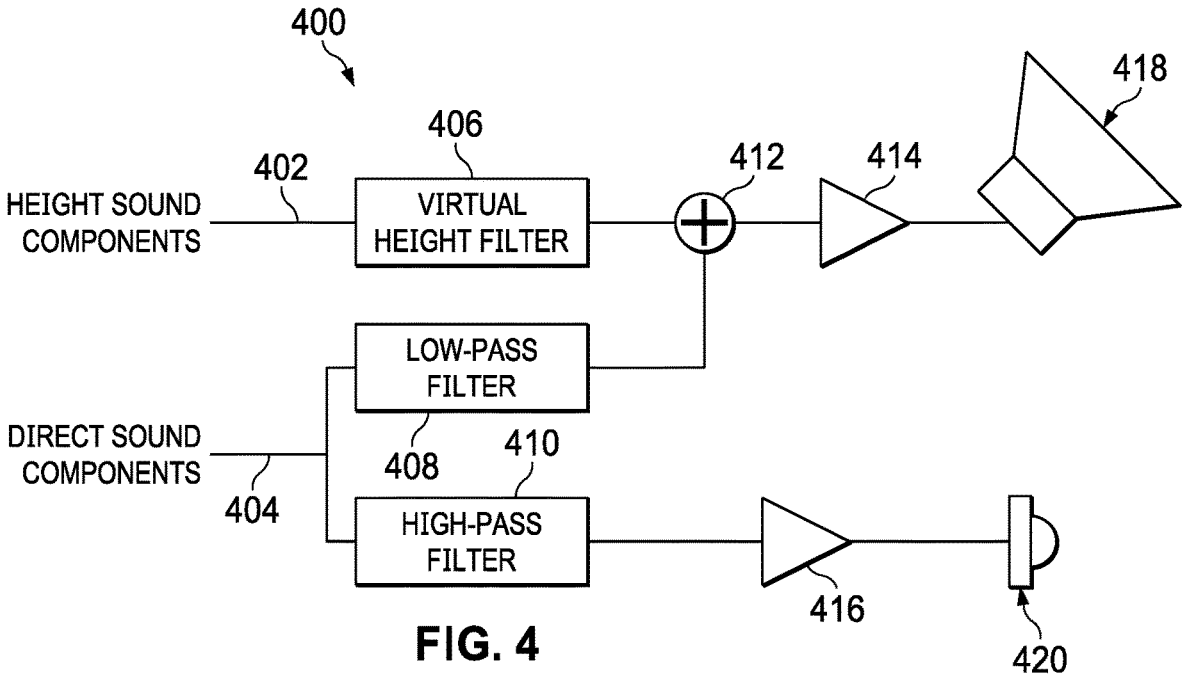
FIG. 4 illustrates a circuit configuration of the upward firing speaker enclosure of FIG. 2, under some embodiments.

In an embodiment, the speaker 200 is driven by height sound components and direct sound components through two channels signals that are transmitted to the respective drivers through certain filter and amplifier circuits. FIG. 4 illustrates a circuit configuration of the upward firing speaker enclosure of FIG. 2A, under some embodiments. In circuit 400 of FIG. 4, the direct sound components are transmitted for playback through the front-firing tweeter 420 through a crossover circuit comprising a low-pass filter 408 and a high-pass filter 410. The low-pass filter cuts the low frequency signals from the direct sound components and sends these to combinatorial circuit (adder) 412 to be played through the woofer 418. The high frequency signals passed through the high-pass filter 410 are amplified through amplifier 416 and then sent to tweeter 420 for projection directly into the listening environment. The height sound components 402 are transmitted to the upward firing woofer 418 through a virtual height filter 406 and amplifier 404. Woofer 418 thus projects upward for reflection down into the listening environment the low frequency signals of the direct sound components and the full range of signals from the height sound components as they are combined in adder 412 and amplified by amp 414. Because a tweeter does not require much power, amp 416 for the direct sound components can be relatively small and low power, such as on the order of 15 W depending on the speaker and room size. This helps reduce component count and keep component costs low.

In an embodiment, in combination with the delay circuit, the crossover filters may be configured or selected to provide substantial phase matching of the responses of both the woofer and the tweeter in the direction of the tweeter toward the listening area. For this embodiment, the crossover filters and delay circuits are selected such that the two drivers have substantial acoustic phase match in the forward direction of the tweeter.

In an embodiment, the virtual height filter 406 (also referred to as a "Pinna filter") is used to compensate for height cues present in sound waves transmitted directly through the listening environment in favor of height cues present in the sound reflected off the upper surface of the listening environment, as will be described in greater detail below.

Figure 5A:
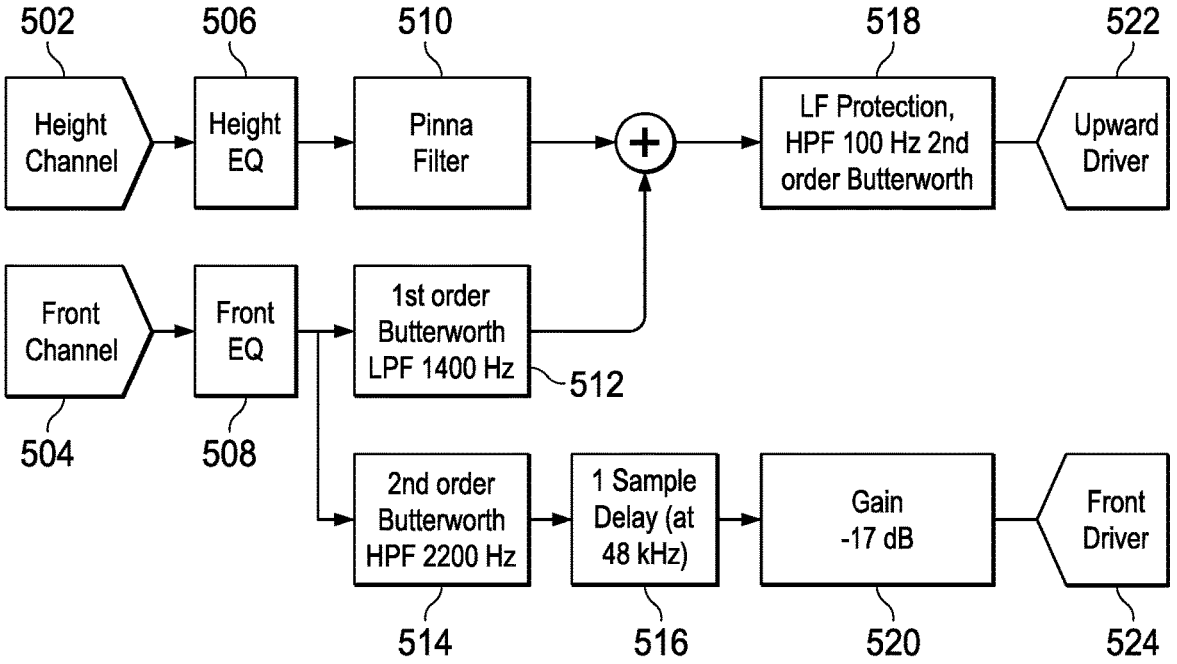
FIG. 5A illustrates the circuit configuration of FIG. 4 with slightly more detail, under an embodiment.

FIG. 5A illustrates the circuit configuration of FIG. 4 with slightly more detail, under an embodiment. For the embodiment of FIG. 5A, the height sound components are embodied in a height channel signal 502 and the direct sound components are embodied in a front channel signal 504. Both channels are input through respective equalizers 506 and 508 to flatten the frequency response of the direct and height sound components. The height channel is sent through Pinna filter 510 and a low frequency protection circuit to the upward firing woofer 522. The low frequency protection circuit 518 may be implemented as a high-pass filter with a cutoff frequency on the order of 100 Hz to prevent excessively low frequencies from passing to the woofer 518, which may be implemented as a relatively small (e.g., 3") cone driver.

The front channel signal 504 is sent through a high-pass filter 514 and on to the front driving tweeter 524 through a delay circuit 516 and an attenuator 520. The delay circuit 516 is used to time align the woofer and tweeter signals to compensate for the fact that the tweeter is placed well forward of the woofer relative to the listener, as can be seen in FIGS. 2A and 2C. An appropriate amount of delay can be provided based on the size and configuration of the speaker. The attenuator 520 is used to compensate for the fact that the tweeter 524 is typically more efficient than the woofer 522. The attenuator is used to pad the tweeter to provide appropriate relative gains between the two disparate drivers. In an embodiment, attenuator 520 may be provided as a discrete circuit, or it may be embodied as a differential gain such as by a low powered amplifier for the tweeter 524 and a higher powered amplifier for the woofer 522.

Figure 5B:
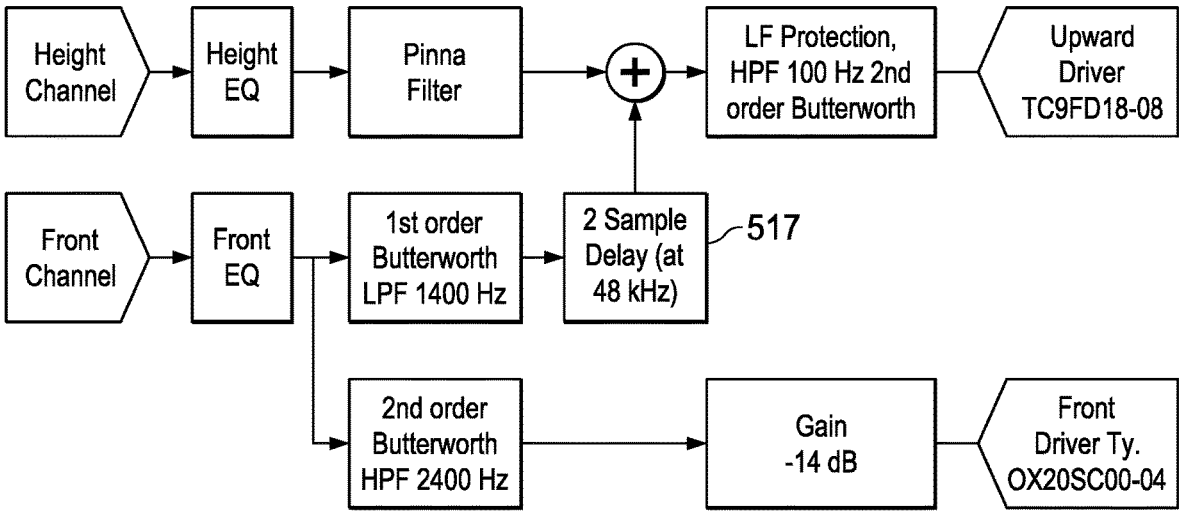
FIG. 5B illustrates the circuit configuration of FIG. 4 with slightly more detail, under an alternative embodiment.

Variations of the circuit of FIG. 5A under alternative embodiments are possible with respect to any of the components. FIG. 5B illustrates the circuit configuration of FIG. 4 with slightly more detail, under one such alternative embodiment. In this embodiment, the delay circuit 517 is interposed between the low-passed front channel signal and the adder circuit so that the low frequency component of the front-channel signal is delayed relative to the height channel signal with which it is combined. FIG. 5B illustrates one possible alternate embodiment to the circuit of FIG. 5A and many other alternative circuit elements or connections are also possible.

Figure 6:
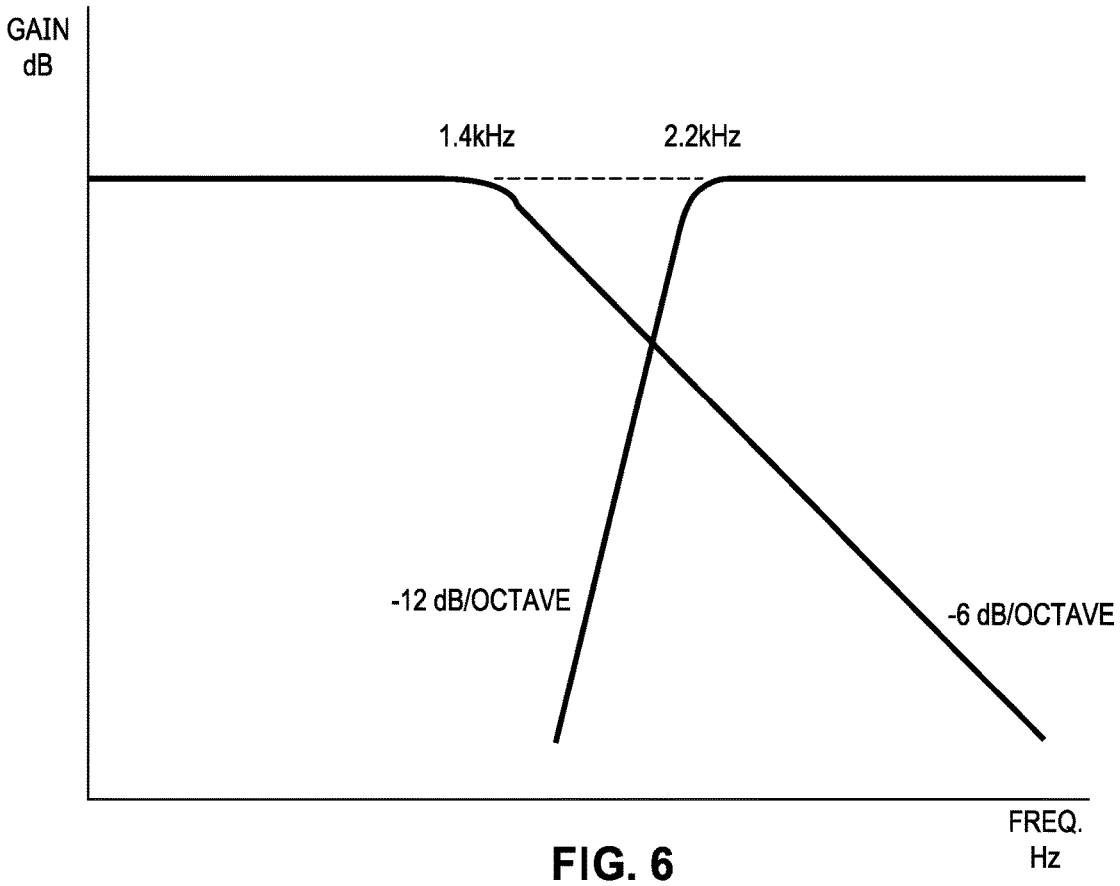
FIG. 6 is a frequency plot illustrating operation of the cross over circuit of FIG. 5 under an embodiment.

For the embodiment of FIG. 5A, crossover circuit filters 512 and 514 separate the low frequencies of the front channel signal and passes them to the woofer through an adder circuit. The crossover points and slopes may be configured according to specific requirements based on the speaker configuration, room size, audio content, and so on. In an example embodiment, the low-pass filter 512 is implemented as a $1^{st}$ order Butterworth filter that passes all signals of the front channel below 1400 Hz to the woofer 522 and cuts them from tweeter 524, and the high-pass filter is implemented as a $2^{nd}$ order Butterworth filter that passes all signals of the front channel above 2200 Hz to the tweeter 524 and cuts all signals below 2200 Hz. FIG. 6 is a frequency plot illustrating operation of the cross over circuit of FIG. 5A under an embodiment. As shown in FIG. 6, the low-pass filter curve 602 cuts off the front channel signal above 1.4 kHz at a rate of −6 dB/octave for a $1^{st}$ order filter, and the high-pass filter curve cuts off the front channel signal below 2.2 kHz at a rate of −12 dB/octave for a $2^{nd}$ order filter. The filter curves and configuration of FIG. 6 are provided for example only, and any appropriate high and low-pass filters, or other types of crossover circuits may be used.

Virtual Height Filter

As shown in FIG. 4, the circuit 400 includes a virtual height filter (or Pinna filter in FIG. 5A). For this embodiment, an adaptive audio system utilizes the upward-firing driver to provide the height element for overhead audio objects. This is achieved partly through the perception of reflected sound from above as shown in FIG. 1. In practice, however, sound does not radiate in a perfectly directional manner along the reflected path from the upward-firing driver. Some sound from the upward firing driver will travel along a path directly from the driver to the listener, diminishing the perception of sound from the reflected position. The amount of this undesired direct sound in comparison to the desired reflected sound is generally a function of the directivity pattern of the upward firing driver or drivers. To compensate for this undesired direct sound, it has been shown that incorporating signal processing to introduce perceptual height cues into the audio signal being fed to the upward-firing drivers improves the positioning and perceived quality of the virtual height signal. For example, a directional hearing model has been developed to create a virtual height filter, which when used to process audio being reproduced by an upward-firing driver, improves that perceived quality of the reproduction. In an embodiment, the virtual height filter is derived from both the physical speaker location (approximately level with the listener) and the reflected speaker location (above the listener) with respect to the listening position. For the physical speaker location, a first directional filter is determined based on a model of sound travelling directly from the speaker location to the ears of a listener at the listening position. Such a filter may be derived from a model of directional hearing such as a database of HRTF (head related transfer function) measurements or a parametric binaural hearing model, pinna model, or other similar transfer function model that utilizes cues that help perceive height. Although a model that takes into account pinna models is generally useful as it helps define how height is perceived, the filter function is not intended to isolate pinna effects, but rather to process a ratio of sound levels from one direction to another direction, and the pinna model is an example of one such model of a binaural hearing model that may be used, though others may be used as well.

An inverse of this filter is next determined and used to remove the directional cues for audio travelling along a path directly from the physical speaker location to the listener. Next, for the reflected speaker location, a second directional filter is determined based on a model of sound travelling directly from the reflected speaker location to the ears of a listener at the same listening position using the same model of directional hearing. This filter is applied directly, essentially imparting the directional cues the ear would receive if the sound were emanating from the reflected speaker location above the listener. In practice, these filters may be combined in a way that allows for a single filter that both at least partially removes the directional cues from the physical speaker location, and at least partially inserts the directional cues from the reflected speaker location. Such a single filter provides a frequency response curve that is referred to herein as a "height filter transfer function," "virtual height filter response curve," "desired frequency transfer function," "height cue response curve," or similar words to describe a filter or filter response curve that filters direct sound components from height sound components in an audio playback system.

With regard to the filter model, if $P_1$ represents the frequency response in dB of the first filter modeling sound transmission from the physical speaker location and $P_2$ represents the frequency response in dB of the second filter modeling sound transmission from the reflected speaker position, then the total response of the virtual height filter $P_T$ in dB can be expressed as: $P_T=\alpha(P_2-P_1)$, where $\alpha$ is a scaling factor that controls the strength of the filter. With $\alpha=1$, the filter is applied maximally, and with $\alpha=0$, the filter does nothing (0 dB response). In practice, $\alpha$ is set somewhere between 0 and 1 (e.g. $\alpha=0.5$) based on the relative balance of reflected to direct sound. As the level of the direct sound increases in comparison to the reflected sound, so should c in order to more fully impart the directional cues of the reflected speaker position to this undesired direct sound path. However, $\alpha$ should not be made so large as to damage the perceived timbre of audio travelling along the reflected path, which already contains the proper directional cues. In practice a value of $\alpha=0.5$ has been found to work well with the directivity patterns of standard speaker drivers in an upward firing configuration. In general, the exact values of the filters $P_1$ and $P_2$ will be a function of the azimuth of the physical speaker location with respect to the listener and the elevation of the reflected speaker location. This elevation is in turn a function of the distance of the physical speaker location from the listener and the difference between the height of the ceiling and the height of the speaker (assuming the listener's head is at the same height of the speaker).

Figure 7:
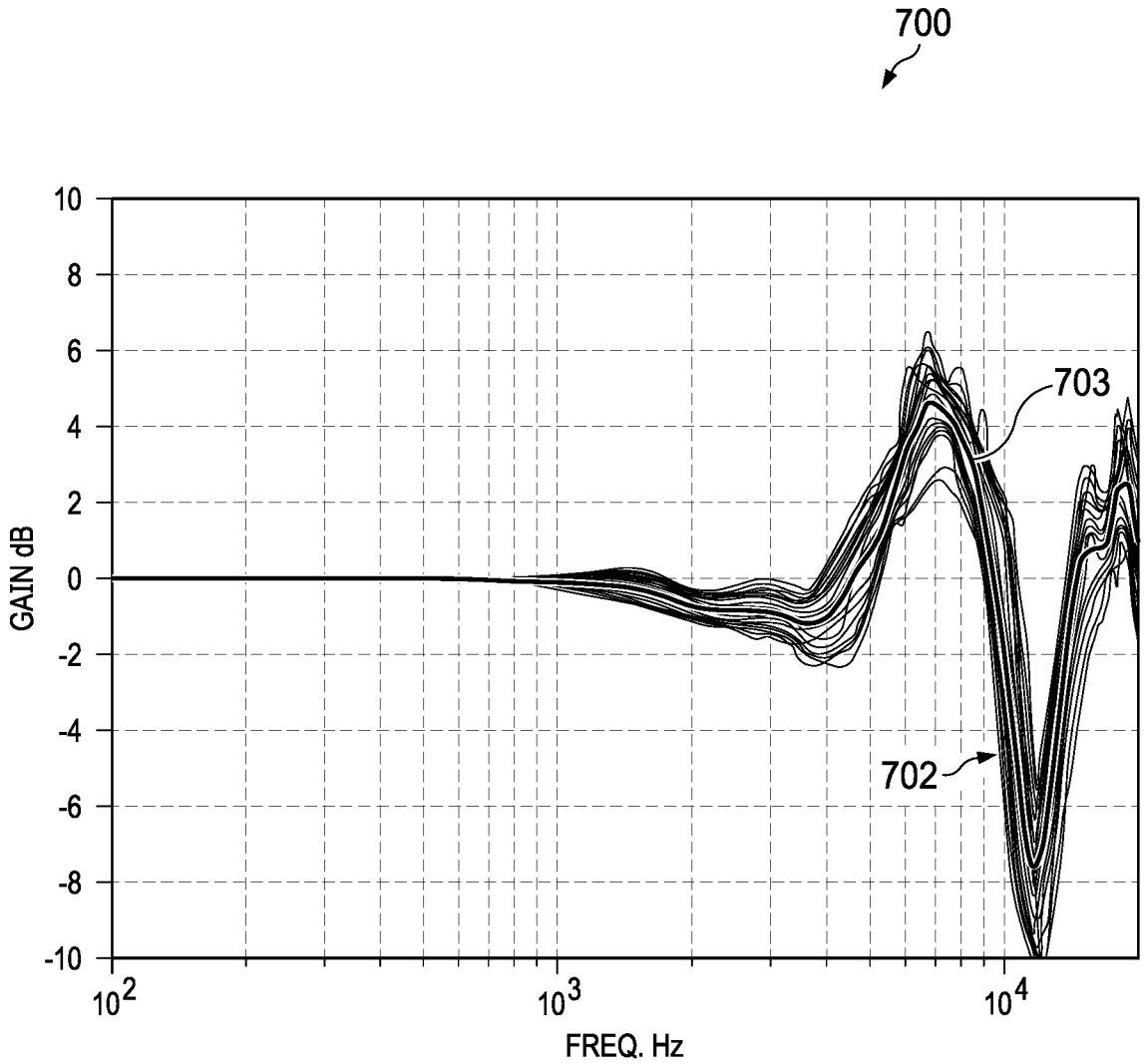
FIG. 7 is a graph that illustrates the magnitude response of a virtual height filter derived from a directional hearing model, under an embodiment.

FIG. 7 depicts virtual height filter responses $P_T$ with $\alpha=1$ derived from a directional hearing model based on a database of HRTF responses averaged across a large set of subjects. The black lines 703 represent the filter $P_T$ computed over a range of azimuth angles and a range of elevation angles corresponding to reasonable speaker distances and ceiling heights. Looking at these various instances of $P_T$, one first notes that the majority of each filter's variation occurs at higher frequencies, above 4 Hz. In addition, each filter exhibits a peak located at roughly 7 kHz and a notch at roughly 12 kHz. The exact level of the peak and notch vary a few dB between the various responses curves. Given this close agreement in location of peak and notch between the set of responses, it has been found that a single average filter response 702, given by the thick gray line, may serve as a universal height cue filter for most reasonable physical speaker locations and room dimensions. Given this finding, a single filter $P_T$ may be designed for a virtual height speaker, and no knowledge of the exact speaker location and room dimensions is required for reasonable performance. For increased performance, however, such knowledge may be utilized to dynamically set the filter $P_T$ to one of the particular black curves in FIG. 7, corresponding to the specific speaker location and room dimensions.

The typical use of such a virtual height filter for virtual height rendering is for audio to be pre-processed by a filter exhibiting one of the magnitude responses depicted in FIG. 7 (e.g. average curve 702), before it is played through the upward-firing woofer 204. The filter may be provided as part of the speaker unit, or it may be a separate component that is provided as part of the renderer, amplifier, or other intermediate audio processing component.

The virtual height filter may be implemented in the speaker either on its own or with or as part of a crossover circuit that separates input audio frequencies into high and low bands, or more depending on the crossover design. Either of these circuits may be implemented as a digital DSP circuit or other circuit that implements an FIR (finite impulse response) or IIR (infinite impulse response) filter to approximate the virtual height filter curve. Either of the crossover, separation circuit, and/or virtual height filter may be implemented as passive or active circuits, wherein an active circuit requires a separate power supply to function, and a passive circuit uses power provided by other system components or signals.

Figures 8A, 8B:
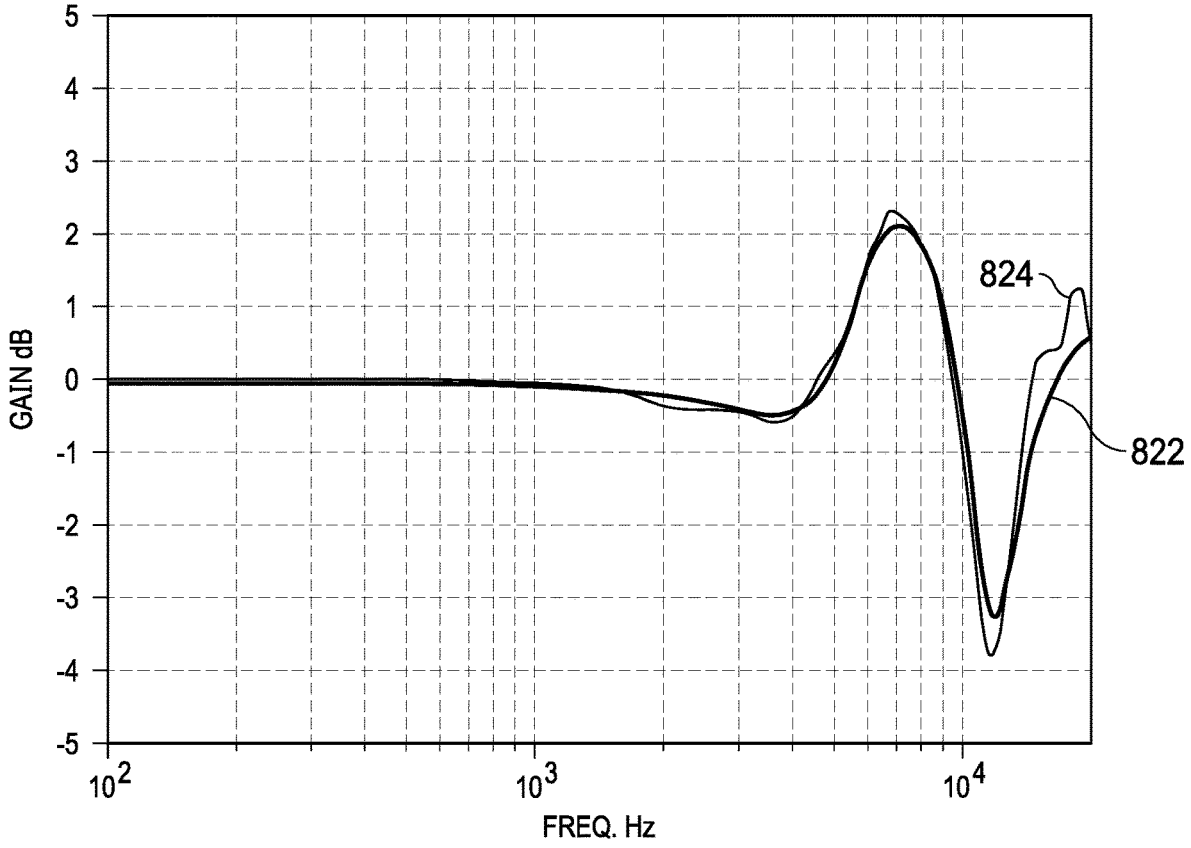
FIG. 8A illustrates example coefficient values for a digital implementation of a virtual height filter, under an embodiment.
FIG. 8B illustrates an example frequency response curve of the filter of FIG. 17A along with a desired response curve.

FIG. 8A depicts a digital implementation of the height cue filter for use in a powered speaker employing a DSP or active circuitry. The filter is implemented as a fourth order IIR filter with coefficients chosen for a sampling rate of 48 kHz. This filter may alternatively be converted into an equivalent active analog circuit through means well known to one skilled in the art. FIG. 8B depicts an example frequency response curve 824 of this filter along with a desired response curve 822.

Figure 9:
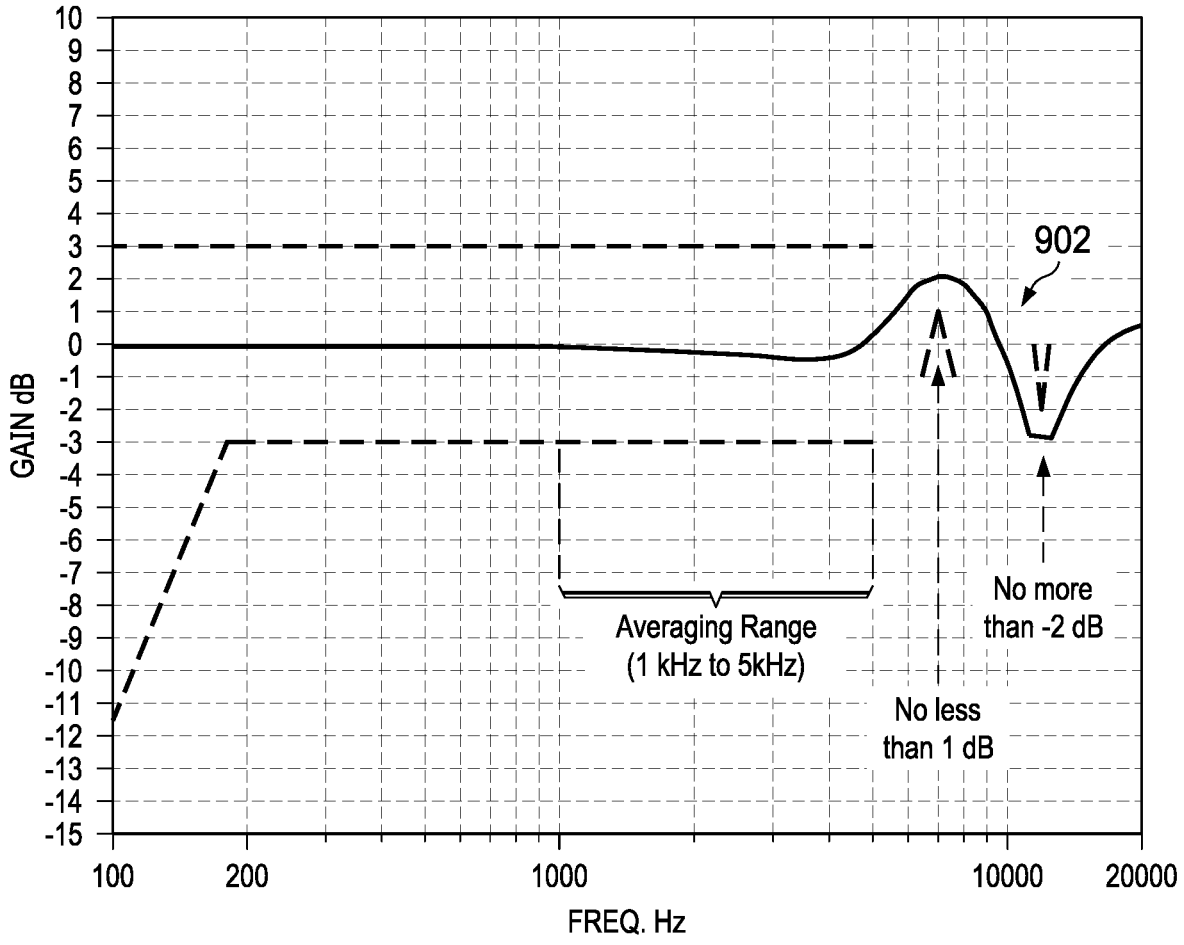
FIG. 9 illustrates a target transfer function to optimize the height reflected sound using a virtual height filter under an embodiment.

In an embodiment, a passive or active height cue filter is applied to create a target transfer function to optimize the height reflected sound. The frequency response of the system, including the height cue filter, as measured with all included components, is measured at one meter on the reference axis using a sinusoidal log sweep and must have a maximum error of ±3 dB from 180 Hz to 5 kHz as compared to the target curve using a maximum smoothing of one-sixth octave. Additionally, there should be a peak at 7 kHz of no less than 1 dB and a minimum at 12 kHz of no more than −2 dB relative to the mean from 1,000 to 5,000 Hz. It may be advantageous to provide a monotonic relationship between these two points. For the upward-firing driver, the low-frequency response characteristics shall follow that of a second-order high-pass filter with a target cut-off frequency of 180 Hz and a quality factor of 0.707. It is acceptable to have a rolloff with a corner lower than 180 Hz. The response should be greater than −13 dB at 90 Hz. Self-powered systems should be tested at a mean SPL in one-third octave bands from 1 to 5 kHz of 86 dB produced at one meter on the reference axis using a sinusoidal log sweep. FIG. 9 illustrates a target transfer function to optimize the height reflected sound using a virtual height filter under an embodiment. Plot 902 of FIG. 9 illustrates a target transfer plot for the target parameters described above in an example embodiment. It should be noted that FIG. 9 is provided for illustration only, and other values and plot characteristics are also possible.

System and Speaker Configuration

The circuit elements of FIG. 5 may be implemented as an analog circuit using known analog components (e.g., capacitors, inductors, resistors, etc.) and known circuit designs. Alternatively, it may be implemented as a digital circuit using digital signal processor (DSP) components, logic gates, programmable arrays, or other digital circuits. The crossover, virtual height filter, and amplification functions may be provided as part of the renderer component (Audio Video Receiver, or AVR) or built-in to the speaker itself, or as part of an intermediate circuit between the renderer and the speaker.

Figure 10:
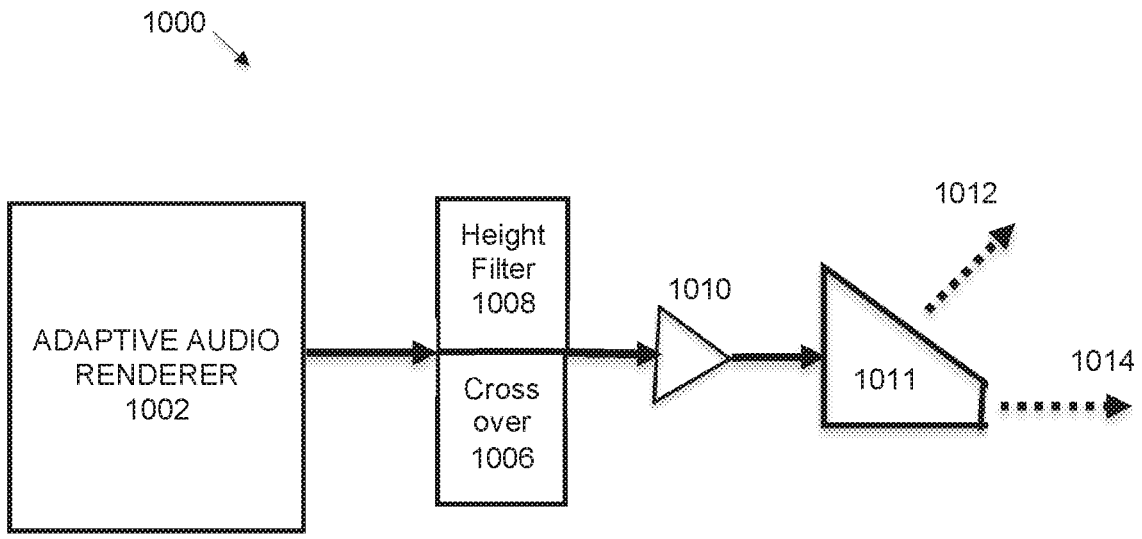
FIG. 10 illustrates a virtual height filter incorporated as part of a speaker system having an upward-firing driver, under an embodiment.

FIG. 10 illustrates a virtual height filter incorporated as part of a speaker system having an upward-firing driver, under an embodiment. As shown in system 1000 of FIG. 10, an adaptive audio renderer (AVR) 1002 outputs audio signals that contain separate height signal components and direct signal components. The height signal components are meant to be played through an upward-firing driver 1012, and the direct audio signal component is meant to be played through a direct-firing driver 1014. The signal components are not necessarily different in terms of frequency content or audio content, but are instead differentiated on the basis of height cues present in the audio objects or signals. For the embodiment of FIG. 10, a height filter 1008 contained within or otherwise associated with rendering component 1002 compensates for any undesired direct sound direct sound components that may be present in the height signal by providing perceptual height cues into the height signal to improve the positioning and perceived quality of the virtual signal. Such a height filter may incorporate the reference curve shown in FIG. 7. A crossover circuit 1006 cuts off the low-frequency signals from the direct tweeter driver 1014 and combines them with the height channel played through the full-range woofer 1012. One or more amplifiers 1010 power the speaker 1011. Any or all of the height filter 1008, crossover 1006 and amplifier 1010 may be embodied as circuits within the AVR component 1002 or as one or more standalone components between the AVR and speaker 1011, as shown. Alternatively, these functions may be built in to the speaker 1011 to produce a standalone speaker that can easily be coupled to a standard adaptive audio renderer or immersive audio AVR.

Alternate Speaker Configurations

Figure 11:
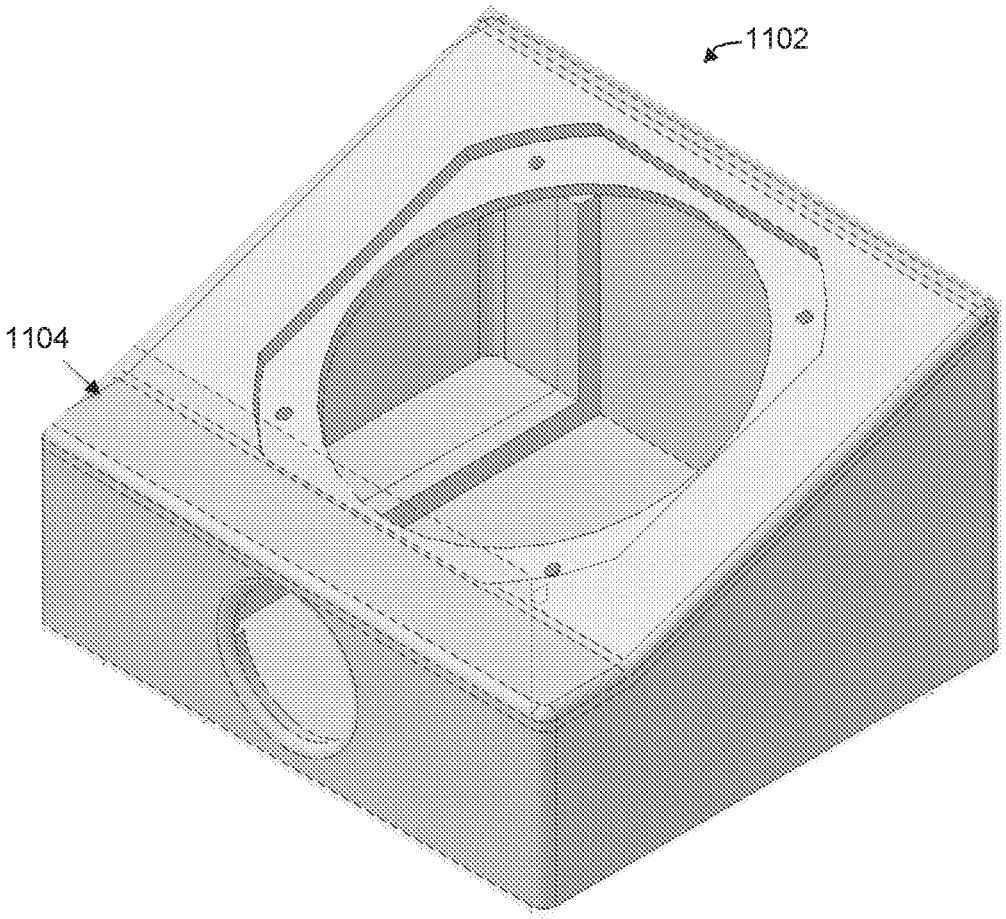
FIG. 11 is a perspective view of a speaker enclosure under an alternative embodiment.

As stated previously, the upward firing or reflective speaker enclosure may be configured to house any practical number and size of drivers for either or both of the upward-firing woofer and front-firing tweeter drivers. The enclosure itself may also be shaped and configured to suit different sound projection and application needs. The embodiments described herein have shown an enclosure that is substantially trapezoidal in side-view shape, but embodiments are not so limited. FIG. 11 illustrates a speaker enclosure under an alternative embodiment in which the front-firing tweeter is mounted in a protruding front portion 1104 of the speaker. Other alternative embodiments are also possible, such as one that places the tweeter closer to or even underneath a portion of the woofer cone, and so on.

Figure 12A:
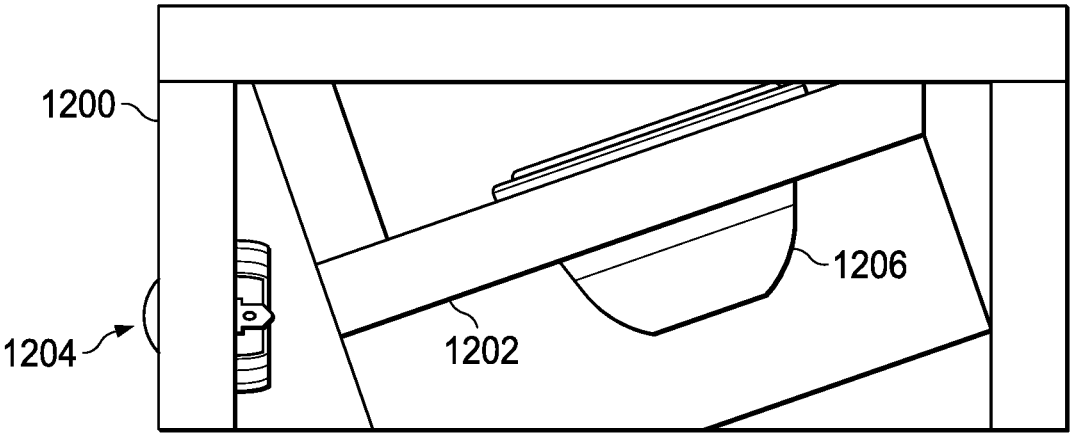
FIG. 12A a configuration of the upward-firing speaker under another alternative embodiment.
Figure 12B:
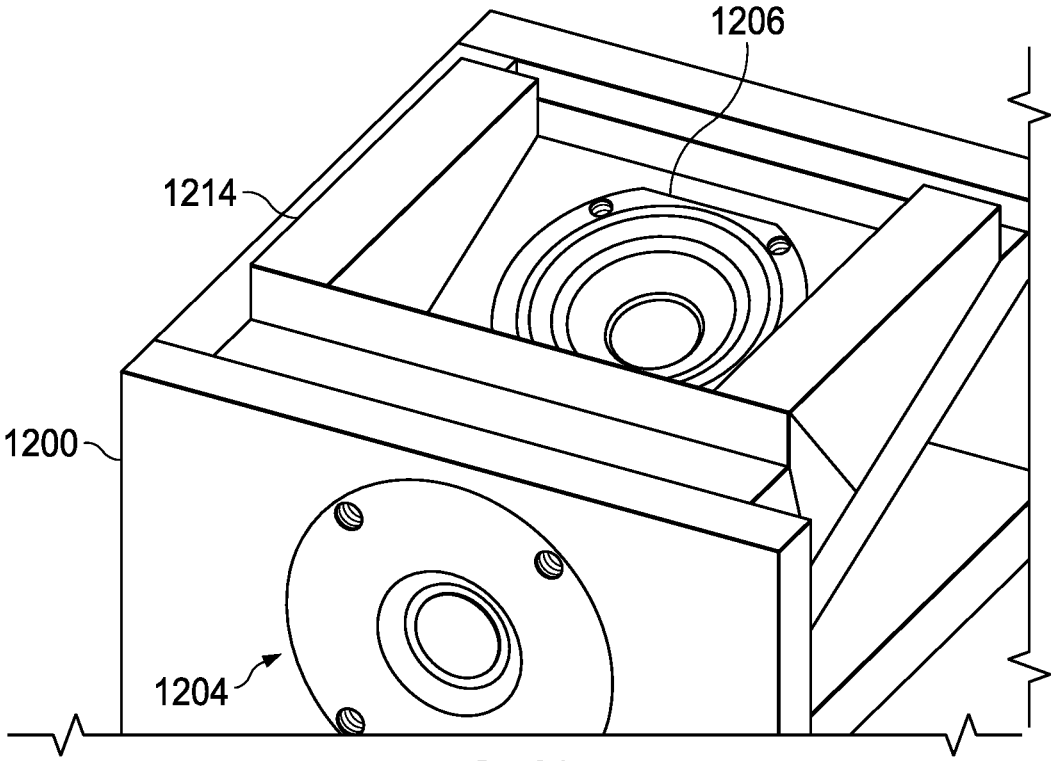
FIG. 12B is a partial top view of the speaker cabinet of FIG. 12A.

FIG. 12A a configuration of the upward-firing speaker under another alternative embodiment. For the embodiment of FIG. 12A, speaker 1200 has an upward-firing speaker 1206 is recessed into the top of the enclosure and mounted to an internal surface 1202 that is tilted at an appropriate angle allowing the speaker to fire at an upward angle of 20° (or any other appropriate angle). The inner shelf 1202 provides acoustic separation and loading for the upward-firing woofer 1206 and the front-firing tweeter 1204. FIG. 12B is a partial top view of the speaker cabinet of FIG. 12A. The speaker cabinet 1200 may have sound-absorbing foam 1214 at least partially surrounding the upward-firing driver 1206, under an embodiment. The sound absorbing foam 1214 is shown as partially surrounding the upward-firing driver due to the fact that the upper part of the cabinet is angled. Alternatively, it may be configured to fully surround the driver, or foam may be placed only along certain perimeters of the driver, depending on acoustical characteristics. The sound-absorbing foam is used in the recessed area of the speaker cabinet around the upward-firing driver to reduce the effects of standing waves and diffraction, effectively smoothing the frequency response of the drivers. Any appropriate material and thickness of foam may be used depending on speaker size constraints and acoustic requirements.

Certain other functions may also be provided as part of the sound processing function of the speaker and/or renderer circuit for audio signals sent to the upward firing speaker. These include bypass switching for the height channel, room correction using audio test signals played back through an AVR with connected speakers, automatic frequency equalization and/or volume compensation, system calibration using pre-emphasis filtering, and other similar functions. Such functions are described in U.S. Patent Publication 2015/0350804 based on U.S. patent application Ser. No. 14/421,768 with a priority date of Aug. 31, 2012, which is hereby incorporated by reference in its entirety.

Figure 13:
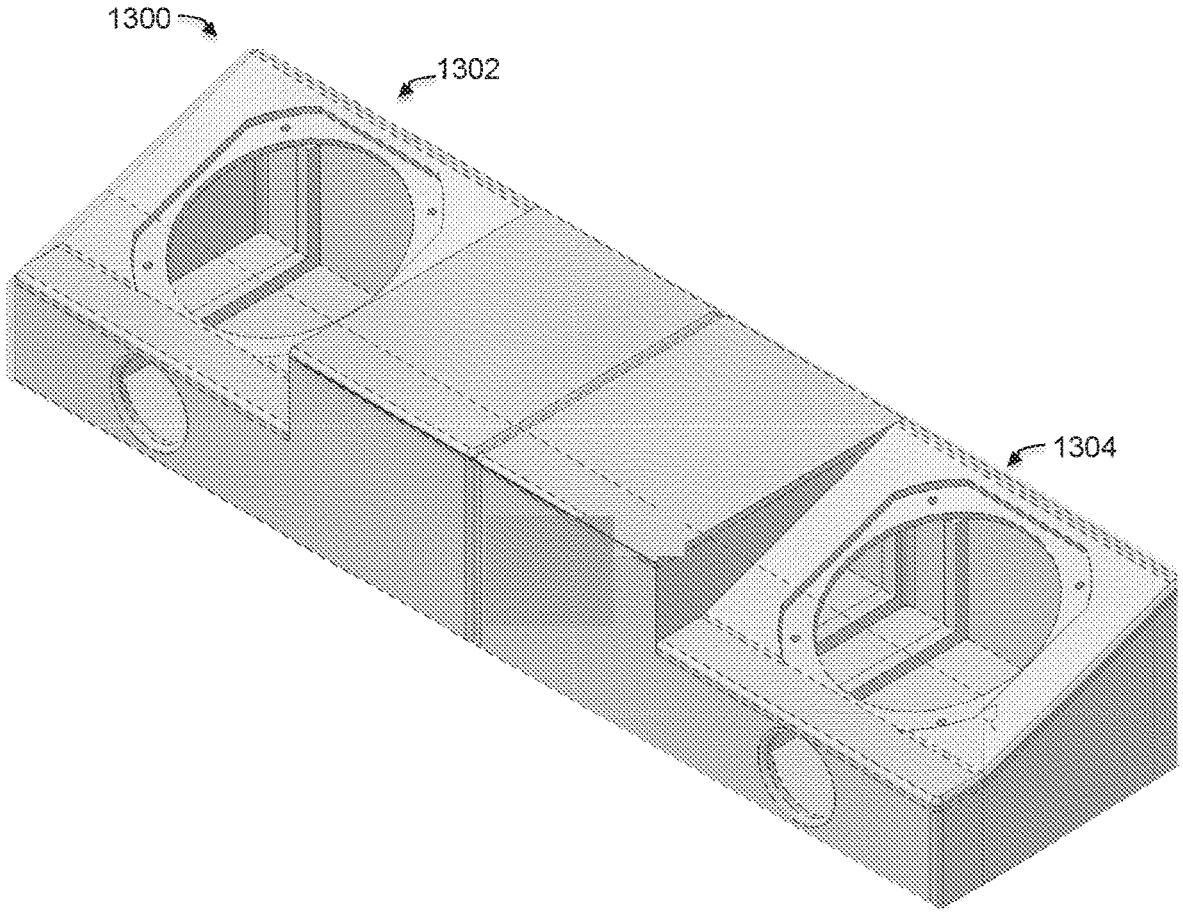
FIG. 13 illustrates a soundbar having two upward-firing speakers under an embodiment.

Embodiments have been described with respect an enclosure for a single set of front and upward firing drivers, and two such speakers may be used for stereo playback, or multiple such speakers may be used in a surround sound system. In an embodiment, the enclosures may be combined or configured to provide a soundbar speaker system that has two or more respective sets of front/upward-firing drivers separated by a defined distance. FIG. 13 illustrates a soundbar having two upward-firing speakers under an embodiment. For the embodiment of FIG. 13, two separate speakers 1302 and 1304 are coupled together to form a soundbar unit 1300. The driver sets for each speaker may be separated by a prescribed distance as set by spacers or housings formed into the individual speakers. Alternatively, the soundbar enclosure may be a single long rectangular unitary enclosure that has appropriate cutouts for each set of woofer/tweeter drivers for the front and height channels. Any number of driver sets may be included in a soundbar as desired. The soundbar may include internal baffles or walls to provide acoustic separation between the different sets of drivers.

The speaker enclosure of FIG. 2 or the soundbar speaker of FIG. 13 may also include one or more side-firing drivers to project sound out of the sides of the enclosure. These drivers may either be woofer or tweeter drivers, and may be configured to project sound directly into the listening environment, or reflect sound off of other room surfaces, such as walls. The reflective speaker enclosure may also be configured to project sound downwards so that it is reflected back up into the listening environment off of the floor. In these embodiments, the characteristic of the pinna filter may change due to the differing orientations. In these embodiments as well, the upward-firing speaker may be referred to as a "reflective speaker" since it is configured to reflect (bounce) the full-range driver sound off of a surface other than the ceiling or top of a listening environment.

Figure 14A:
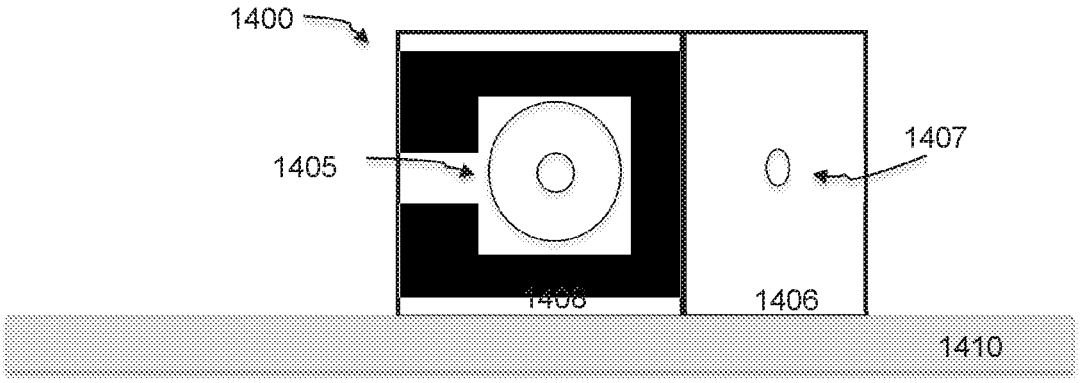
FIG. 14A illustrates a reflective speaker placed on the floor on its side so as to reflect sound off of a wall or side surface of the listening environment.
Figure 14B:
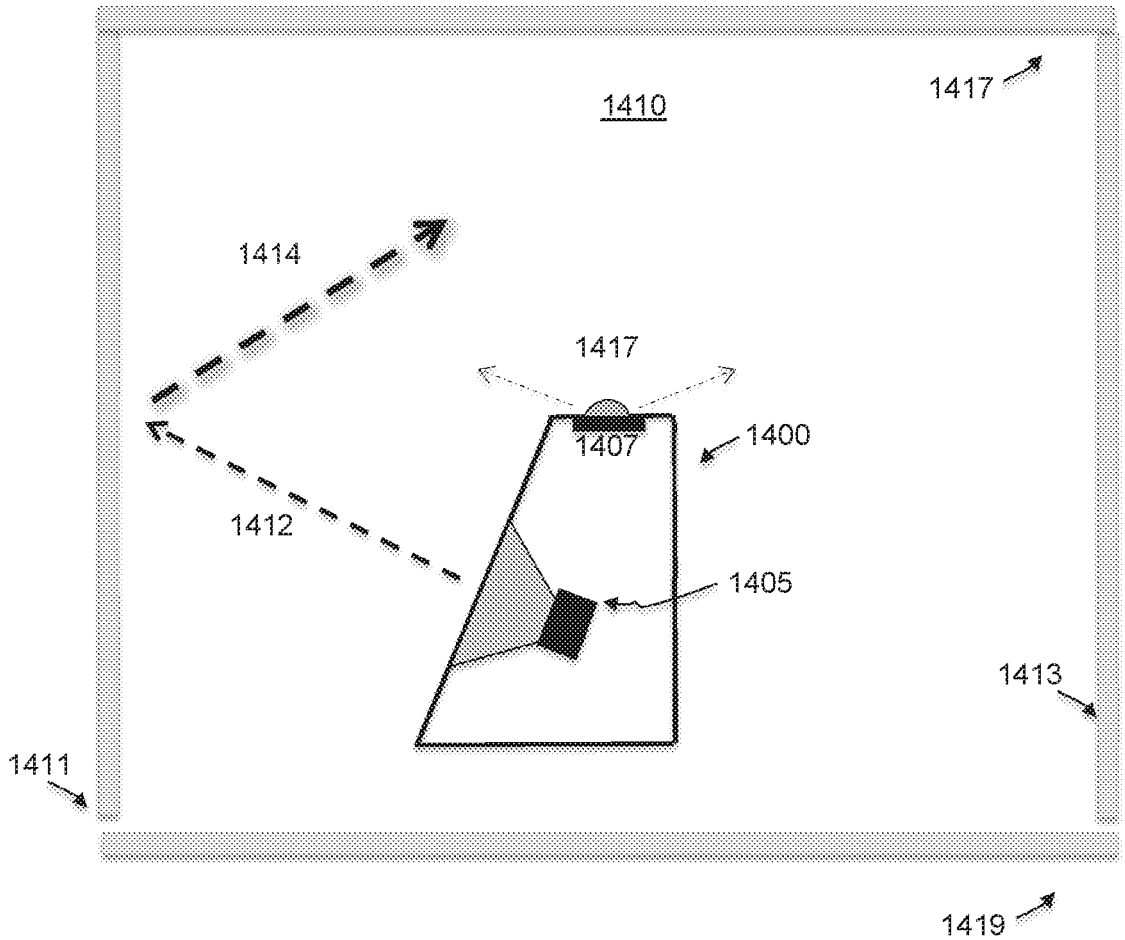
FIG. 14B shows the speaker FIG. 14A in a room and placed such that it reflects sound into the room, in an example implementation.

FIG. 14A illustrates a reflective speaker placed on the floor 1410 on its side so as to reflect sound off of a wall or side surface of the listening environment (room). For this embodiment, the enclosure 1400 is placed on its side on the floor 1410 so that the tweeter 1407 on surface 1406 projects into the room while woofer 1408 in surface 1408 is configured to reflect sound off of the wall. FIG. 14B shows the speaker 1400 of FIG. 14A in a room and placed such that it reflects sound into the room. FIG. 14B is a top view looking down onto the floor 1410 of the room bordered by side walls 1411 and 1413 and front/back walls 1417 and 1419, with speaker 1400 placed on the floor. The speaker is placed or angled so that the woofer 1405 projects sound 1412 to wall 1411 to produce reflected sound waves 1414. The tweeter 1407 projects the high frequency signals routed to it in its usual wide dispersive pattern 1417. The speaker 1400 may be placed or rotated to project to the walls at any angle based on the slope of angled surface 1408 relative to front surface 1406.

For this embodiment as well as those that reflect sound off of any surface other than the ceiling (for an upward firing speaker), the virtual height filter will be different in terms of the filter settings since sound is reflected off the side and not the ceiling. In this case, the virtual height filter is configured to compensate for reflected sound cues present in sound waves transmitted directly through the listening environment in favor of the reflected sound cues present in the sound reflected off the upper surface of the listening environment. These reflected sound cues could be side cues or bottom cues depending on which surface from which the sound is reflected.

Figure 15:
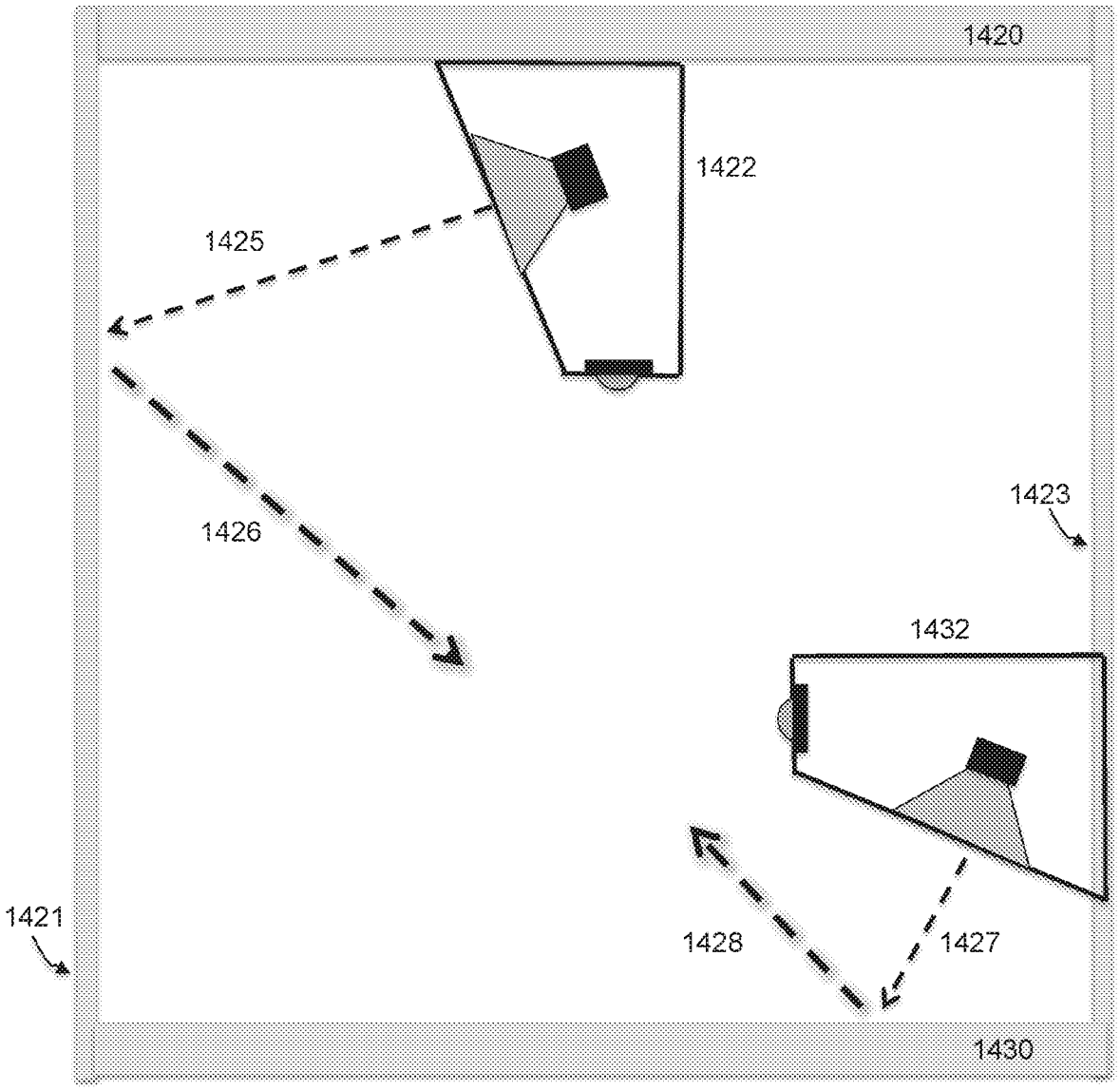
FIG. 15 illustrates different configurations of a reflective speaker under some embodiments.

The upward firing speaker of FIG. 2 can also be mounted on the wall or ceiling to become a reflective speaker by orienting the full-range driver to project against a wall or other surface, such as the floor, screens, partitions, and so on. FIG. 15 illustrates different mounting and placement configurations of a reflective speaker to reflect sound into a room, under some embodiments. FIG. 15 is a view looking into a room having a ceiling 1420 and floor 1430 with vertical walls 1421 and 1423. A speaker 1422 is mounted on the ceiling 1420 and positioned so that it acts as a side-downward firing speaker by projecting its woofer sound 1425 onto wall 1421 to be reflected 1426 down into the room. Speaker 1432 is mounted on a wall 1423 and positioned so that it acts as a downward firing speaker by projecting its woofer sound onto the floor 1430 and back up into the room. Different mounting locations and tilt angles can be used as desired to achieve a preferred sound distribution through the room, such as appropriate mounting hardware and/or swivel or servo mounts to rotate the woofers as needed.

As can be seen in FIGS. 14B and 15, the combination woofer/tweeter design takes advantage of the fact that the tweeters remain widely dispersive throughout their crossed over frequency range regardless of their orientation, thus allowing the full-range woofer to be oriented accordingly to achieve a desired reflection. The angled surface 1408 and relatively smaller flat front surface 1406 facilitate flush mounting of the bottom surface of the enclosure in a manner that still achieves angled sound transmission for reflection against any surface of the room. It should be noted that the speaker implementation figures are not drawn to scale, and are provided as examples only. Any placements, orientations, mountings, and configurations are possible within the embodiments described herein.

Figure 16A:
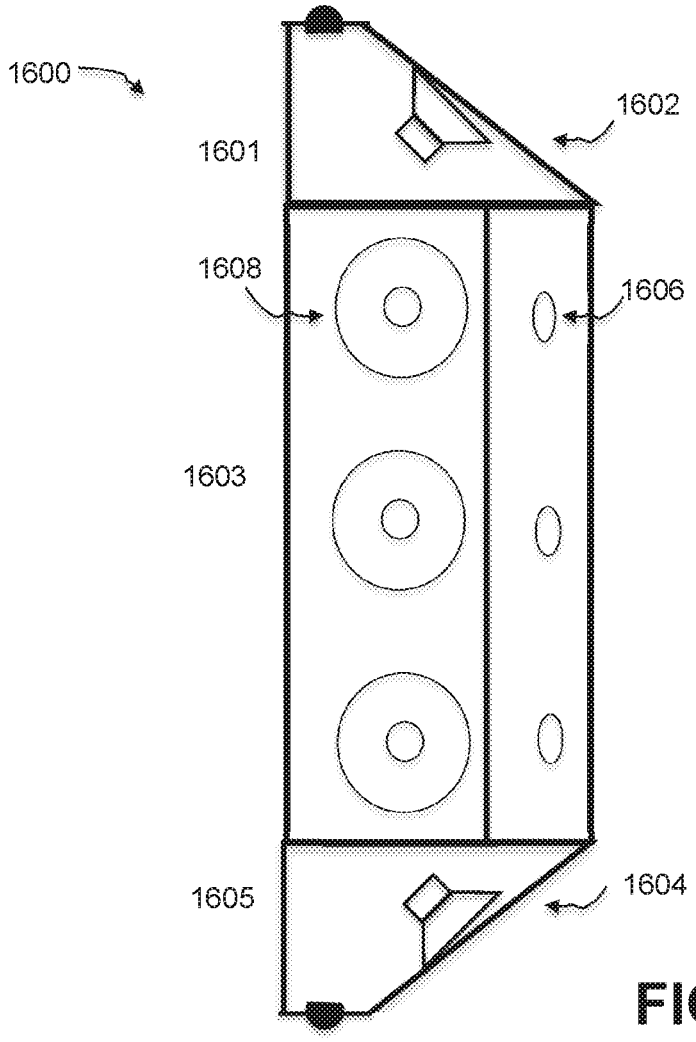
FIG. 16A is a top view of a combined upward and side firing soundbar, under some embodiments.
Figure 16B:
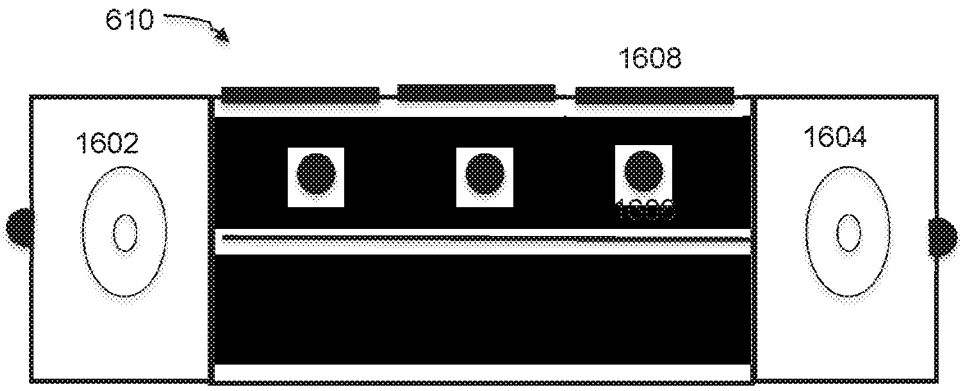
FIG. 16B is a front view of the combined soundbar of FIG. 16A.

As stated previously, the upward or reflective speaker enclosure may be configured to include one or more side or bottom firing drivers along with the front tweeter and upward firing woofer. For example, the soundbar embodiment of FIG. 13 may be extended to include one or more reflective firing drivers so that the soundbar projects sound in various directions including different direct-firing tweeter patterns and different angled reflected pattern. FIG. 16A is a top view of a combined upward and side firing soundbar, under some embodiments, and FIG. 16B is a front view of the combined soundbar of FIG. 16A. As shown in FIG. 16A, soundbar 1600 includes a center speaker array 1603 containing a number (e.g., three) upward firing speakers with the tweeters 1606 projecting forward and the woofers projecting upward. On either side of soundbar 1603 are placed side-firing speakers 1601 and 105 with their respective drivers firing to the side or at an angle defined by surfaces 1602 and 1604. FIG. 16B illustrates a front view of soundbar 1600 as seen when placed horizontally on the floor and showing the side firing woofers on surfaces 1602 and 1604 firing at an angle toward the room.

The embodiment of the soundbar system shown in FIGS. 16A and 16B is intended for illustration only and any number and orientation of woofer/tweeter pairs is possible as well as number and configuration of side speakers attached to the soundbar. The soundbar 1600 may be placed or mounted horizontally as shown in FIG. 16B or it may be mounted vertically or even wall or ceiling mounted.

Figure 17A:
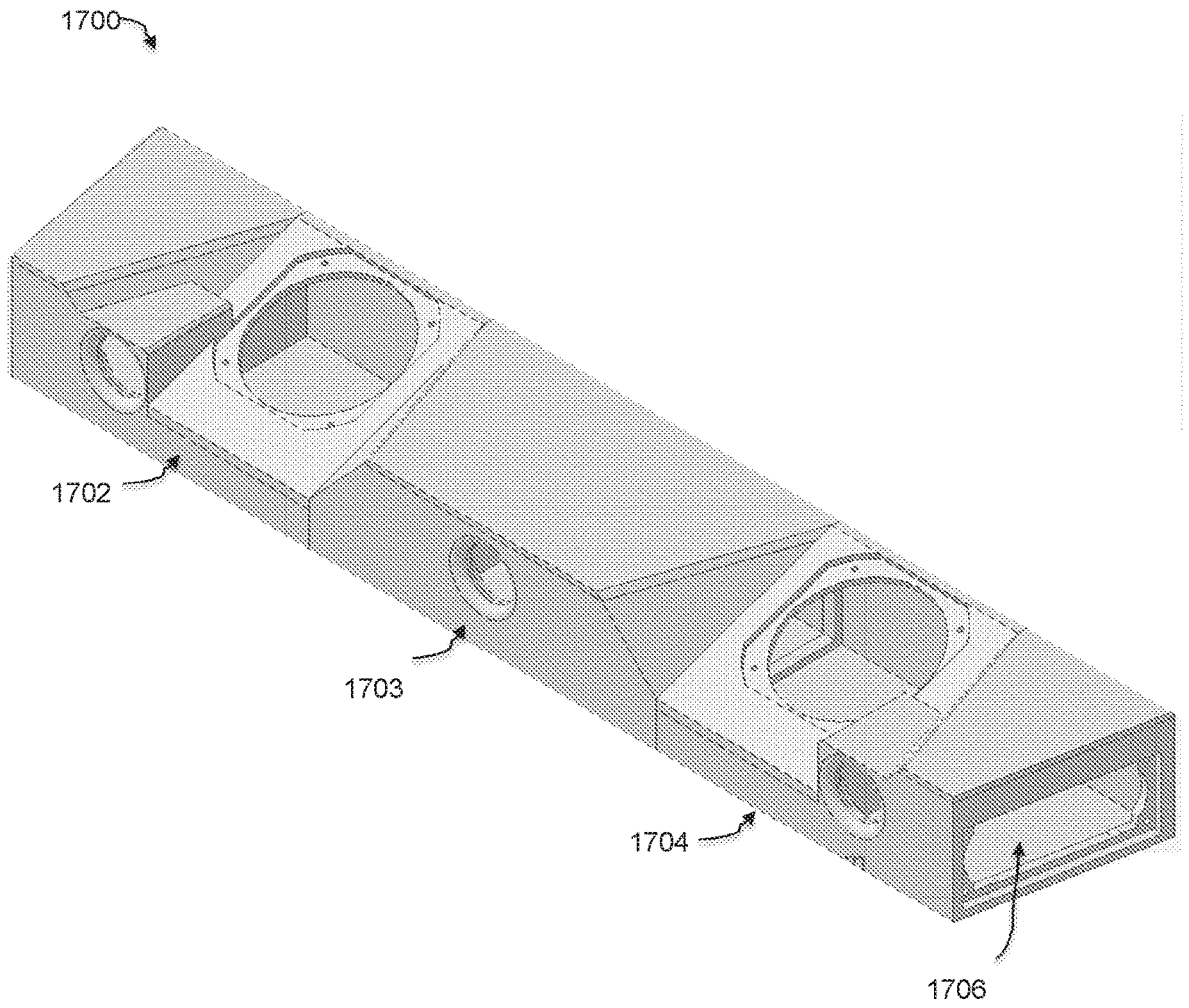
FIG. 17A is a perspective view illustrating one example alternative embodiment of a soundbar having multiple upward-firing speakers.

FIG. 17A is a perspective view illustrating one example alternative embodiment of a soundbar having multiple upward-firing speakers. As shown in FIG. 17, soundbar 1700 includes at least two upward firing speakers 1702 and 1704 placed on the end of a soundbar enclosure that has a direct-firing tweeter 1703 in the center. A side opening 1706 may also be able to house a side-firing or other driver, if desired. Soundbar 1700 also illustrates an embodiment in which the tweeter is offset from a center axis of the woofer. This embodiment allows for greater compactness of the enclosure as it allows the enclosure to be "flattened" somewhat, though maybe a bit wider as compared to the embodiment of FIG. 13.

Figure 17B:
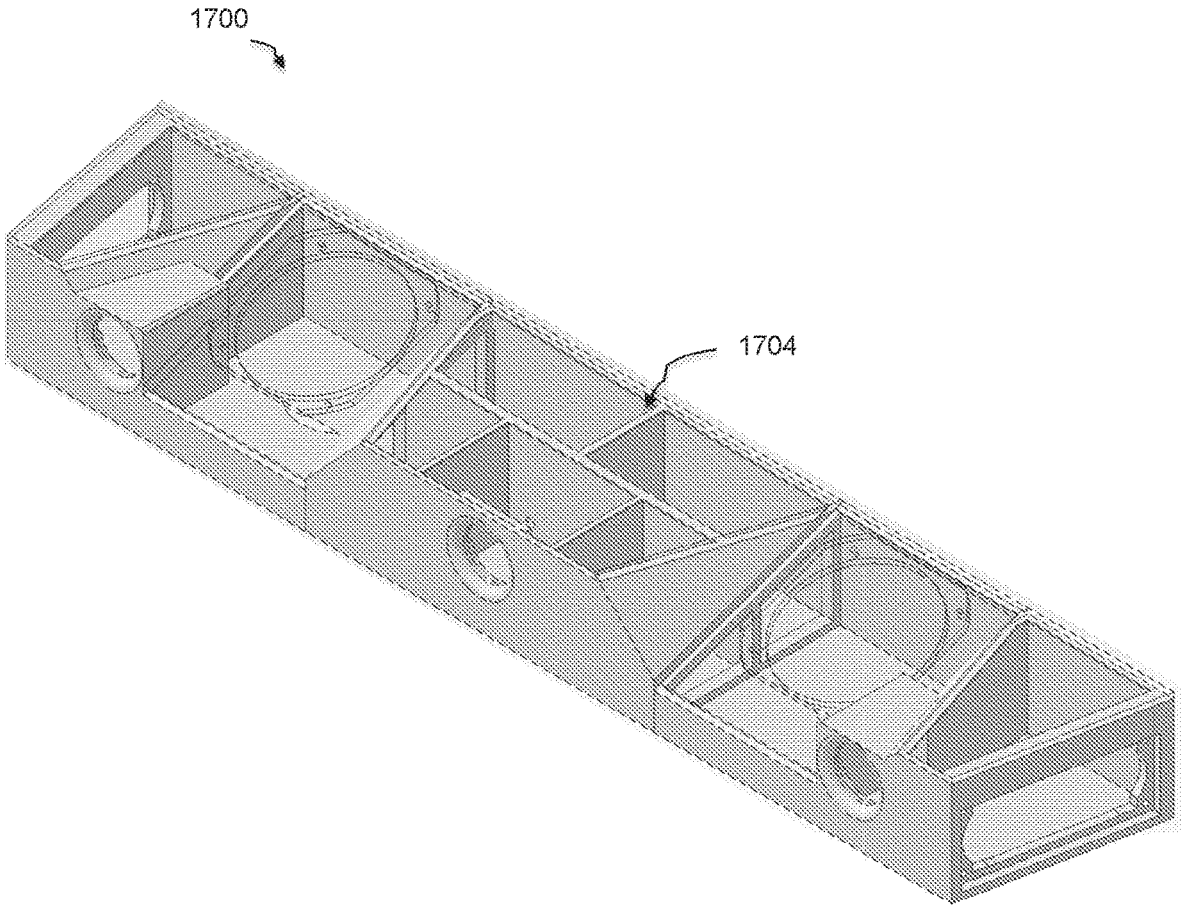
FIG. 17B is a cutaway view of the soundbar of FIG. 17A showing internal chambers and baffling.

The internal structure of any of the speaker enclosures or soundbars may include chambers or baffling to modify the sound produced by the speakers. FIG. 17B is a cutaway view of the soundbar of FIG. 17A showing internal chambers and baffling, under an embodiment. As shown in FIG. 17B, soundbar 1700 includes individual chambers for the different drivers as well as structural or acoustic partitions or baffles 1704 for sections, such as the center section. The configuration shown in FIG. 17B is meant to be for illustration only, and any other different internal configuration is also possible.

The speakers used in an adaptive audio system that implements reflective height speakers and virtual height filtering for a home theater or similar listening environment may use a configuration that is based on existing surround-sound configurations (e.g., 5.1, 7.1, 9.1, etc.). In this case, a number of drivers are provided and defined as per the known surround sound convention, with additional drivers and definitions provided for the upward-firing sound components. The upward-firing and direct-firing drivers may be packaged in various different configurations with different stand-alone driver units and combinations of drivers in unitary cabinets.

The dimensions and construction materials for the speaker cabinet may be tailored depending on system requirements, and many different configurations and sizes are possible. For example, in an embodiment, the cabinet may be made of medium-density fiberboard (MDF), or other material, such as wood, fiberglass, Perspex, and so on; and it may be made of any appropriate thickness, such as 0.75" (19.05 mm) for MDF cabinets. The speaker may be configured to be of a size conforming to bookcase speakers, floor standing speakers, desktop speakers, or any other appropriate size.

As stated previously, the optimal angle for an upward firing speaker is the inclination angle of the virtual height driver that results in maximal reflected energy on the listener. In an embodiment, this angle is a function of distance from the speaker and ceiling height. While generally the ceiling height will be the same for all virtual height drivers in a particular room, the virtual height drivers may not be equidistant from the listener or listening position 106. The virtual height speakers may be used for different functions, such as direct projection and surround sound functions. In this case, different inclination angles for the upward firing drivers may be used. For example, the surround virtual height speakers may be set at a shallower or steeper angle as compared to the front virtual height drivers depending on the content and room conditions. Furthermore, different $\alpha$ scaling factors may be used for the different speakers, e.g., for the surround virtual height drivers versus the front height drivers. Likewise, a different shape magnitude response curve may be used for the virtual height model that is applied to the different speakers. Thus, in a deployed system with multiple different virtual height speakers, the speakers may be oriented at different angles and/or the virtual height filters for these speakers may exhibit different filter curves.

In general, the upward-firing speakers incorporating virtual height filtering techniques as described herein can be used to reflect sound off of a hard ceiling surface to simulate the presence of overhead/height speakers positioned in the ceiling. A compelling attribute of the adaptive audio content is that the spatially diverse audio is reproduced using an array of overhead speakers. As stated above, however, in many cases, installing overhead speakers is too expensive or impractical in a home environment. By simulating height speakers using normally positioned speakers in the horizontal plane, a compelling 3D experience can be created with easy to position speakers. In this case, the adaptive audio system is using the upward-firing/height simulating drivers in a new way in that audio objects and their spatial reproduction information are being used to create the audio being reproduced by the upward-firing drivers. The virtual height filtering components help reconcile or minimize the height cues that may be transmitted directly to the listener as compared to the reflected sound so that the perception of height is properly provided by the overhead reflected signals.

Embodiments of the upward-firing speaker described herein provide certain packaging efficiency and manufacturing cost savings over other reflective speaker designs by integrating the full range audio signals with the height component signals through the use of an upward firing woofer. The use of a front-firing tweeter provides effective high frequency playback and saves the cost and space of a front-firing woofer and the associated amplifier/processing circuits. This design partially removes the forward facing driver from other designs, and integrates the low frequencies into the upward facing driver (which is omnidirectional at low frequencies), with a separate forward facing tweeter for high frequencies. The height channel still uses the upward facing driver across all frequencies, along with the virtual height filter. This allows for one less large driver, and a much smaller amplifier for the front as compared to the other designs.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Various aspects of the present disclosure may be appreciated from the following enumerated example embodiments (EEEs):

1. A speaker for transmitting sound waves to be reflected off an upper surface of a listening environment, comprising:
a cabinet;
a direct-firing tweeter driver mounted to a front-facing surface of the cabinet and oriented to transmit sound along a horizontal axis substantially perpendicular to a front surface of the cabinet; and
an upward-firing full-range driver mounted to a sloping surface of the cabinet and oriented at an inclination angle of between 18 degrees to 22 degrees relative to the horizontal axis.

2. A speaker for transmitting sound waves to be reflected off an upper surface of a listening environment, comprising:
a cabinet;
a tweeter driver mounted to a certain surface of the cabinet and oriented to transmit sound along a horizontal axis substantially perpendicular to a front surface of the cabinet; and
a full-range driver mounted to a sloping surface of the cabinet and oriented at an inclination angle of between 18 degrees to 22 degrees relative to the horizontal axis.

3. The speaker of EEE 2, wherein said inclination angle is an angle between said horizontal axis and a mounting plane of said full-range driver.

4. The speaker of EEE 2 or 3, wherein the tweeter driver is oriented to transmit sound in a forward direction along said horizontal axis, and wherein the full-range driver is oriented to transmit sound in a direction which forms an acute angle relative to said forward direction.

5. The speaker of any one of EEEs 2 to 4, further comprising:
a first input configured to receive a first signal comprising first sound components;
a low-pass filter configured to receive the first sound components and pass low frequency signals thereof to the full-range driver; and
a virtual height filter coupled to the full-range driver.

6. The speaker of EEE 5, wherein the virtual height filter is configured to apply a frequency response curve to a signal transmitted to the full-range driver to create a target transfer curve.

7. The speaker of EEE 5 or 6, wherein the virtual height filter is configured to compensate for height cues present in sound waves transmitted directly through the listening environment in favor of height cues present in the sound reflected off the upper surface of the listening environment.

8. The speaker of any one of EEEs 5 to 7, wherein said first sound components are direct sound components.

9. The speaker of any one of EEEs 5 to 8, wherein said first signal is a front channel signal.

10. The speaker of any one of EEEs 5 to 9, further comprising a high-pass filter configured to receive said first sound components and pass high frequency signals thereof to the tweeter driver.

11. The speaker of any one of EEEs 2 to 10, further comprising a second input configured to receive a second signal comprising second sound components to be sent to the full-range driver for reflection down to the listening area.

12. The speaker of EEE 11, wherein said second sound components are height sound components.

13. The speaker of EEE 11 or 12, wherein said second signal is a height channel signal.

14. The speaker of any one of EEEs 2-13, wherein said certain surface is a front-facing surface of the cabinet.

15. The speaker of any one of EEEs 2-14, wherein the tweeter driver is a direct-firing tweeter driver, and wherein the full-range driver is an upward-firing full-range driver.16. The speaker of EEE 1 or 15 wherein the upward-firing full-range driver is mounted flush to an upward sloping side of the cabinet or inset within a top surface of the cabinet and configured to reflect sound off a reflection point on a ceiling of the listening environment, and wherein a corresponding angle for direct response from the upward-firing driver is nominally 70 degrees from the horizontal axis.

17. The speaker of EEE 1, 15 or 16 further comprising a first input receiving a front channel signal comprising direct sound components to be sent to the direct-firing tweeter, and a second input receiving a height channel signal receiving height sound components to be sent to the upward-firing full-range driver for reflection down to the listening area.

18. The speaker of any preceding EEE further comprising a crossover coupled to the direct-firing tweeter, the crossover comprising a high-pass filter passing high frequency signals of the direct sound components directly to the tweeter, and a low-pass filter passing low frequency of the direct sound components to the upward-firing full-range driver.

19. The speaker of any preceding EEE further comprising: a delay circuit configured to time align the direct-firing tweeter and the upward-firing full-range driver by compensating for a spatial distance between the two relative to the listening area.

20. The speaker of any preceding EEE wherein the delay and crossover filters are configured such that the acoustic energy of the full-range driver and tweeter sum to give substantially maximum acoustic energy in the direct or forward direction of the tweeter.

21. The speaker of any preceding EEE further comprising an attenuation circuit configured to attenuate the direct sound components to compensate for a difference in driver efficiency between the full-range driver and the tweeter.

22. The speaker of any preceding EEE, further comprising a virtual height filter circuit coupled to the upward-firing full-range driver and applying a frequency response curve to a signal transmitted to the upward-firing driver to create a target transfer curve, and, wherein the virtual height filter compensates for height cues present in sound waves transmitted directly through the listening environment in favor of height cues present in the sound reflected off the upper surface of the listening environment.

23. The speaker of any preceding EEE wherein the cabinet is configured to hold two or more sets of upward-firing full-range drivers and direct-firing tweeters in a soundbar configuration.

24. A speaker system for reflecting sound waves off a room ceiling to a listening position in the room, comprising:

a cabinet;

a direct-firing tweeter within the cabinet and oriented to transmit sound along a horizontal axis substantially perpendicular to a front surface of the cabinet;

an upward-firing full-range driver mounted to an inclined top surface of the cabinet and configured to reflect sound off a reflection point on the ceiling, and wherein a corresponding angle for direct response from the upward-firing driver is nominally 70 degrees from the horizontal axis; and a virtual height filter circuit applying a frequency response curve to a signal transmitted to the upward-firing driver to create a target transfer curve that compensates for height cues present in sound waves transmitted directly through the room in favor of height cues present in the sound reflected off the ceiling by at least partially removing directional cues from the speaker location and at least partially inserting directional cues from the reflection point.

25. The speaker system of EEE 24 further comprising a first input receiving a front channel signal comprising direct sound components to be sent to the direct-firing tweeter, and a second input receiving a height channel signal receiving height sound components to be sent to the upward-firing full-range driver for reflection down to the listening area.

26. The speaker system of EEE 25 further comprising a crossover coupled to the direct-firing tweeter, the crossover comprising a high-pass filter passing high frequency signals of the direct sound components directly to the tweeter, and a low-pass filter passing low frequency of the direct sound components to the upward-firing full-range driver.

27. The speaker system of any one of EEEs 24 to 26 wherein the cabinet is configured such that the full range driver projects sound against one of a side surface or wall to reflect sound back into the listening area, or a floor to reflect sound back up into the listening area.

28. A method for generating an audio scene from a speaker, the method comprising: receiving first and second audio signals;

routing the first audio signal to a direct-firing tweeter of the speaker;

routing the second audio signal to an upward-firing full-range driver of the speaker;

orienting the upward-firing full-range driver at a defined tilt angle relative to a horizontal angle defined by the front-firing driver in order to transmit sound upward to a reflection point on a ceiling of the room so that it reflects down to a listening area at a distance from the speaker in the room; and applying a virtual height filter frequency response curve to the second audio signal to compensate for height cues present in sound waves transmitted directly through the room in favor of height cues present in the sound reflected off the ceiling of the room.

29. The method of EEE 28 further comprising applying a high-pass filter passing high frequency signals of the first audio signal directly to the tweeter, and a low-pass filter passing low frequency of the second audio signal to the upward-firing full-range driver.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

The invention claimed is:

1. A speaker for transmitting sound waves to be reflected off an upper surface of a listening environment, comprising:

a cabinet;

a direct-firing tweeter driver mounted to a front-facing surface of the cabinet and oriented to transmit sound along a horizontal axis substantially perpendicular to a front surface of the cabinet;

an upward-firing full-range driver mounted to a sloping surface of the cabinet and oriented at an inclination angle of between 18 degrees to 22 degrees relative to the horizontal axis;

a first input receiving a front channel signal comprising direct sound components; and a low-pass filter configured to receive the direct sound components and pass low frequency signals thereof to the upward-firing full-range driver.

2. The speaker of claim 1 further comprising a high-pass filter configured to receive the direct sound components and pass high frequency signals thereof to the direct-firing tweeter driver.

3. The speaker of claim 1 further comprising:

a delay circuit configured to time align the direct-firing tweeter driver and the upward-firing full-range driver by compensating for a spatial distance between the two relative to the listening area.

4. The speaker of claim 3 wherein the delay circuit is provided downstream of the high-pass filter and is configured apply a delay to the high frequency signals passed from the high-pass filter to the direct-firing tweeter driver.

5. The speaker of claim 3 wherein the delay and the filters are configured such that the acoustic energy of the full-range driver and tweeter sum to give substantially maximum acoustic energy in the direct or forward direction of the tweeter.

6. The speaker of claim 1 further comprising an attenuation circuit configured to attenuate the direct sound components to compensate for a difference in driver efficiency between the full-range driver and the tweeter.

7. The speaker of claim 6 wherein the attenuation circuit is provided downstream of the high-pass filter and is configured to attenuate the high frequency signals passed from the high-pass filter to the direct-firing tweeter driver.

8. The speaker of claim 7 wherein the attenuation circuit is provided downstream of the delay circuit and is configured to attenuate the delayed high frequency signals passed to the direct-firing tweeter driver.

9. The speaker of claim 1 further comprising a second input receiving a height channel signal comprising height sound components to be sent to the upward-firing full-range driver for reflection down to the listening area.

10. The speaker of claim 1, further comprising a virtual height filter circuit coupled to the upward-firing full-range driver and applying a frequency response curve to a signal transmitted to the upward-firing driver to create a target transfer curve, and, wherein the virtual height filter compensates for height cues present in sound waves transmitted directly through the listening environment in favor of height cues present in the sound reflected off the upper surface of the listening environment.

11. The speaker of claim 1 wherein the cabinet is configured to hold two or more sets of upward-firing full-range drivers and direct-firing tweeters in a soundbar configuration.

12. The speaker of claim 1 wherein the upward-firing full-range driver is mounted flush to an upward sloping side of the cabinet or inset within a top surface of the cabinet and configured to reflect sound off a reflection point on a ceiling of the listening environment, and wherein a corresponding angle for direct response from the upward-firing driver is nominally 70 degrees from the horizontal axis.

13. The speaker of claim 1, wherein said inclination angle is an angle between said horizontal axis and a mounting plane of said upward-firing full-range driver.

14. A speaker for transmitting sound waves to be reflected off a ceiling of a listening environment, comprising:

a cabinet;

a direct-firing tweeter driver mounted to a front-facing surface of the cabinet and oriented to transmit sound along a horizontal axis substantially perpendicular to a front surface of the cabinet;

an upward-firing full-range driver mounted to an upward-facing surface of the cabinet and oriented so as to project sound straight up from the upward-facing surface of the cabinet for reflection off of the ceiling of the listening environment back down onto the speaker;

a first input receiving a front channel signal comprising direct sound components; and a low-pass filter configured to receive the direct sound components and pass low frequency signals thereof to the upward-firing full-range driver.

15. The speaker of claim 14 wherein the upward-firing full-range driver is oriented to project sound perpendicular to the horizontal axis and parallel to the front surface of the cabinet.

16. The speaker of claim 14 wherein the sound projected straight up from the upward-firing full-range driver comprises ambient sound content.

17. The speaker of claim 14 wherein the sound projected straight up may be angled slightly from perpendicular to the horizontal axis by modifying an orientation of the upward-firing full-range driver to compensate for acoustic characteristics of the ceiling to maximize the reflection off of the ceiling and back down onto the speaker.

18. The speaker of claim 14 wherein the upward-firing full range driver of claim 17 comprises a driver capable of a full practical range of audio frequencies within a range of 20 to 20 kHz, and is oriented at a 90 degree angle of inclination relative to the horizontal axis of the direct-firing tweeter driver.

* * * * *